US007071889B2

(12) United States Patent
McKinzie, III et al.

(10) Patent No.: US 7,071,889 B2
(45) Date of Patent: Jul. 4, 2006

(54) LOW FREQUENCY ENHANCED FREQUENCY SELECTIVE SURFACE TECHNOLOGY AND APPLICATIONS

(75) Inventors: William E. McKinzie, III, Fulton, MD (US); Gregory S. Mendolia, Ellicott City, MD (US); Rodolfo E. Diaz, Phoenix, AZ (US)

(73) Assignee: Actiontec Electronics, Inc., Sunnyside, CA (US)

( * ) Notice: Subject to any disclaimer, the term of this patent is extended or adjusted under 35 U.S.C. 154(b) by 747 days.

(21) Appl. No.: 10/214,420

(22) Filed: Aug. 6, 2002

(65) Prior Publication Data

US 2003/0071763 A1 Apr. 17, 2003

Related U.S. Application Data

(60) Provisional application No. 60/310,655, filed on Aug. 6, 2001.

(51) Int. Cl.
*H01Q 19/00* (2006.01)
*H01Q 15/02* (2006.01)

(52) U.S. Cl. ..... 343/756; 343/700 MS; 343/909

(58) Field of Classification Search ..... 343/700 MS, 343/756, 895, 909
See application file for complete search history.

(56) References Cited

U.S. PATENT DOCUMENTS

| | | | | |
|---|---|---|---|---|
| 4,074,211 A | | 2/1978 | Bates | 343/700 |
| 4,151,476 A | | 4/1979 | Jasper, Jr. | 343/909 |
| 5,208,603 A | | 5/1993 | Yee | 343/909 |
| 5,483,246 A | | 1/1996 | Barnett et al. | 343/700 |
| 5,936,587 A | | 8/1999 | Gudilev et al. | 343/752 |
| 5,959,594 A | * | 9/1999 | Wu et al. | 343/909 |
| 6,094,170 A | | 7/2000 | Peng | 343/700 |
| 6,218,978 B1 | | 4/2001 | Simpkin et al. | 342/5 |
| 6,373,440 B1 | | 4/2002 | Apostolos | 343/744 |
| 6,380,900 B1 | | 4/2002 | Kanayama | 343/702 |
| 6,452,548 B1 | | 9/2002 | Nagumo et al. | 343/700 |
| 6,476,711 B1 | | 11/2002 | McKinzie et al. | 343/756 |
| 6,774,866 B1 | * | 8/2004 | McKinzie et al. | 343/909 |
| 6,774,867 B1 | * | 8/2004 | Diaz et al. | 343/909 |
| 2002/0024473 A1 | | 2/2002 | Thursby et al. | 343/741 |
| 2002/0118142 A1 | | 8/2002 | Wang | 343/895 |
| 2002/0149521 A1 | | 10/2002 | Hendler et al. | 343/700 |
| 2003/0011518 A1 | | 1/2003 | Sievenpiper et al. | 343/700 |
| 2003/0137457 A1 | * | 7/2003 | McKinzie et al. | 343/700 MS |
| 2003/0142036 A1 | * | 7/2003 | Wilhelm et al. | 343/909 |

* cited by examiner

*Primary Examiner*—Tan Ho
(74) *Attorney, Agent, or Firm*—Brinks Hofer Gilson & Lione

(57) ABSTRACT

DC inductive FSS technology is a printed slow wave structure usable for reduced size resonators in antenna and filter applications of wireless applications. It is a dispersive surface defined in terms of its parallel LC equivalent circuit that enhances the inductance and capacitance of the equivalent circuit to obtain a pole frequency as low as 300 MHz. The effective sheet impedance model has a resonant pole whose free-space wavelength can be greater than 10 times the FSS period. A conductor-backed DCL FSS can create a DC inductive artificial magnetic conductor (DCL AMC), high-impedance surface with resonant frequencies as low as 2 GHz. Lorentz poles introduced into the DCL FSS create multi-resonant DCL AMCs. Antennas fabricated from DCL FSS materials include single-band elements such as a bent-wire monopole on the DCL AMC and multi-band (dual and triple) shorted patches, similar to PIFAs with the patch/lid being a DCL FSS.

63 Claims, 26 Drawing Sheets

400

406

404

402

408

Bottom Metal
P
y
x
P
1004

1000
Top Metal
y
x

1002

Upper and Lower Metal
Upper Metal
Lower Metal 1308
1312
1306
1314
1316
1300
1304
1302
1310
x
y Upper and Lower Metal
Upper Metal
Lower Metal

1406
=

1412
1400
1410
+
1404

1402
1408
1420
1418

Upper and Lower Metal
Upper Metal:
Capacitive Patches
Lower Metal:
Dual Scale UC-PBG
=
+

1606
1620
1600
1618
1604
1602
1608
1612
1610
1614

Via between the grid and the lower (center) patch of the FSS 2214

2202
+

2204
+

Lower capacitive patches 2206
Upper capacitive patches 2208
+

2210
+
2212
=
Total DCL AMC 2200

DCL FSS: 3 x 7 cells
2402
2404
2422

~1.75"
Feed Probe 2412
Shorting Cu Tape 2416
~.75"
2406
2410
2408
2404
2402

1.75"
SMA Connector 2414
Shorting Cu Tape 2416

DCL FSS 2420
3/16" Foam 2408
Cu Tape 2410

DCL-FSS-PIFA D1 Efficiency
Efficiency
Frequency (Ghz)

Realized Gain (dBiL)
Frequency (MHz)

Total gain in dBiL (both polarizations)

Total gain in dBiL (both polarizations)

LOW FREQUENCY ENHANCED FREQUENCY SELECTIVE SURFACE TECHNOLOGY AND APPLICATIONS

BACKGROUND

This application is a non-provisional application claiming priority to provisional application Ser. No. 60/310,655, filed Aug. 6, 2001.

The demand for reduced size consumer electronics has produced a corresponding demand for reduced size electronic components used in these electronics. In portable electronics such as cellular telephones, one of the necessary components is an antenna. The most common type of antenna in cellular telephones are whip antennas because they are relatively cheap and simple to fabricate. However, the gain-bandwidth product of a whip antenna is relatively poor and the size is large.

Uniplanar compact photonic bandgap (UC-PBG) structures have been demonstrated in an attempt to reduce the size of antenna. One example of a UC-PBG structure 100 is shown in FIG. 1. This UC-PBG structure 100 contains a thin sheet of metal with a square lattice of Jerusalem crossed slots 112. The UC-PBG structure 100 may also be described as containing a unit cell 102 of a cloverleaf pattern with petals 104, a center 106, and a straight line segment 108 connecting adjacent centers 106. Neighboring cloverleaf patterns 102 are separated by a gap 110.

In another example of a UC-PBG, K. P. Ma et al. showed that if one places a PEC surface parallel to and electrically close to the UC-PBG structure, then the UC-PBG surface exhibits properties of a high-impedance surface, where it has a zero degree reflection phase for plane waves at normal incidence. Later, Richard Remski at Ansoft Corp. predicted that a conductor-backed UC-PBG also exhibited a full electromagnetic bandgap for surface waves. This was done using finite element (FEM) software to perform an eigenmode analysis on the open structure. However, only one publication addresses the question of a surface wave bandgap for the conductor-backed UC-PBG. No experimental data has yet been published.

While the UC-PBGs above were a step in the right direction, ample motivation still exists to develop antenna technology and apply it to practical filter and antenna applications at UHF and L-band frequencies (300 MHz to 2 GHz) for commercial wireless bands. Previous work on UC-PBGs, for example, demonstrated a fundamental parallel LC resonance near 10 GHz using a period of 0.12 inches, or $\lambda/10$ where $\lambda$ is a free space wavelength at the fundamental resonance. However, for most practical applications the period must be reduced to be much less than $\lambda/10$, typically between $\lambda/50$ and $\lambda/25$. Accordingly, reduction of the unit cell dimensions is necessary.

Fries and Vahldieck disclosed an example of a patch antenna employing the simple UC-PBG in place of a metal patch. They demonstrate a 50% area reduction (0.707 reduction in linear dimensions) with no added manufacturing complexity when both the patch and ground plane have the UC-PGB feature. However, leakage of RF power through the slotted ground plane is a potential EMI concern. In this case, the fundamental resonant frequency of the UC-PBG unit cell was much higher than the fundamental resonant frequency of the patch antenna.

A DC inductive frequency selective surface (DCL FSS) can be used as a microstripline, resulting in a natural slow wave structure, which can be used to fabricate compact multi-band antennas. Some of these structures have been investigated, for example the use of printed periodic transmission lines, or simply an array of circular holes, as the ground plane of a microstripline. However, for many applications a solid ground plane must be used to control leakage and radiation into the rear hemisphere and to define the printed trace of the microstripline to be periodic. An example of this case is a one dimensional PBG cell proposed by Xue, Shum, and Chan. However, this is a 1-D patterned microstripline where only one layer of metal is used. The authors suggest an equivalent circuit, which includes a parallel LC network in series with the microstripline, however, the capacitance is quite small since it is defined by only edge-to-edge coupling. Hence, the fundamental resonant frequency is quite high, on the order of 5 GHz. This frequency is much too high for many conventional wireless applications operating at L band and below.

BRIEF SUMMARY

DC FSS technology is an economical way to create a printed slow wave structure usable for reduced size resonators in antenna and filter applications. Such resonators can be multi-band with engineered non-harmonic resonant frequencies. In designing a DCL FSS, a number of factors need to be considered. First, slots in the ground planes of antennas are avoided as they tend to exacerbate the front-to-back ratio. Second, the simplest DCL FSS, the UC-PBG, reduces the physical size of a printed patch antenna where the patch is a UC-PBG structure. Third, it is possible to make high impedance surfaces from conductor-backed UC-PBGs, and at least some configurations of conductor-backed UC-PBGs may exhibit a surface wave bandgap. The prospect of achieving a surface wave bandgap with a DCL artificial magnetic conductor at low microwave frequencies, and doing so without the cost of vias, or plated through holes, is very appealing for numerous cost-sensitive commercial antenna applications.

The structures of the present DCL FSS teaches derivatives and alternative designs to the published UC-PBG FSS pattern that resonate at much lower frequencies for a given period. This means that DCL FSS structures can have length scales much smaller than the free space wavelengths where they resonate. The application of DCL FSS technology to fabricate an extremely compact antenna is shown, as is its theory of operation in simple to understand terms, which yields insight into the physics of the wave propagation. These antennas may yield multiband and non-harmonically related resonant frequencies.

The DCL FSS is a dispersive surface defined in terms of its parallel LC equivalent circuit. Significant features of various printed circuit embodiments include methods of enhancing the inductance and capacitance of the DCL FSS equivalent circuit to obtain a pole frequency as low as 300 MHz. Even designs without lumped surface mounted components resonate as low as L-band, which makes this material technology very attractive for wireless applications. One characteristic feature is that the effective sheet impedance model for the DCL FSS has a resonant pole whose free-space wavelength can be greater than 10 times the FSS period.

A conductor-backed DCL FSS can be employed to create a form of high-impedance surface called a DC inductive artificial magnetic conductor (DCL AMC). AMC resonant frequencies are demonstrated as low as 2 GHz using simple, printed, low frequency enhanced DCL FSS structures. Also, Lorentz poles can be introduced into the DCL FSS to create a multi-resonant DCL AMCs.

Several types of antennas can be fabricated from DCL FSS materials. One type of single-band element is a bent-wire monopole on the DCL AMC. Another type of single-band element is a multi-band shorted patch, similar to PIFA, except that the patch or PIFA lid is a DCL FSS. Multi-band designs, such as dual and triple band designs are possible.

One of the antenna design factors is the need to reduce the size of mobile terminal antennas. The antenna's largest dimension is often restricted to be no more than $\lambda/10$ at the low band, which is typically near 44 mm for 800 MHz in most mobile terminals. Another need is to provide usable radiation efficiency, typically greater than 25%. Additional design factors that must be considered in fabricating the DCL FSS include the need for multiple resonant frequencies that are almost always non-harmonically related, as well as the stability of the antenna resonant frequency in the presence of other objects. To restate the latter factor: the electrically small multi-band antenna should not be easily de-tuned by the presence of nearby objects. All of these factors must be addressed for internal antennas designed for modem mobile terminals.

A first embodiment of an FSS comprises a first conductive layer having a periodic structure of individual first capacitive patches connected by an inductance greater than an inductance of a single straight line segment between the first capacitive patches.

The inductance may comprise a discrete inductor or may comprise a meanderline having a length substantially longer than the length of the single straight line segment between the first capacitive patches. The meanderline may have different characteristics: being at least twice as long as the length of the single straight line segment between the first capacitive patches, being coplanar with the first capacitive patches, being out of plane with the first capacitive patches, e.g. disposed on a secondary layer substantially parallel with and spaced from the conductive layer. The secondary layer and the conductive layer may be separated by a distance of about 5 mils to about 110 mils.

The first capacitive patches may be rotationally symmetric and may comprise a spiral inductor and an interdigital capacitor. The first capacitive patches may be substantially spiral shaped. In this case, the FSS may further comprise a second conductive layer having a second periodic structure of capacitive patches that are isolated from each other and have a series of fingers that overlap the spiral of a corresponding first capacitive patch. Each first capacitive patch may have a substantially identical shape.

Alternatively, the FSS may further comprise a second conductive layer having a second periodic structure of capacitive patches, the capacitive patches isolated from each other and the first capacitive patches and overlapping a corresponding first capacitive patch of the first conductive layer. Each capacitive patch may overlap each of a plurality of corresponding first capacitive patches of the first conductive layer. Each capacitive patch may comprise a loop. A periodicity of each periodic structure may be at most 250 mils.

An LC circuit that models the FSS may comprise a parallel combination of a first effective inductance and a second effective inductance, the second effective inductance in series with an effective capacitance, the first effective inductance being not less than about 5 times larger than the second effective inductance. The LC circuit may comprise a parallel combination of an effective inductance and an effective capacitance. The inductance may be at least 4 nH/square while the capacitance of the frequency selective surface may be at least 2 pF/square.

DC inductive FSS structures may be employed as band-pass filters with center frequencies as low as 300 MHz. The effective LC circuit may have a pass band with a center frequency of about 200 MHz to about 450 MHz and may have a pole at a frequency substantially lower than 10 GHz.

In a second embodiment, the FSS comprises a first conductive layer having an inductive grid and a periodic structure of individual first capacitive patches coplanar with the inductive grid but isolated from both the inductive grid and each other.

As above, the inductive grid may comprise a meanderline having a length substantially longer than a length of a single straight line segment between intersections of the inductive grid. The meanderline may be coplanar or out of plane.

The FSS may comprise a second conductive layer having a second periodic structure of second capacitive patches isolated from each other and the first capacitive patches and overlapping at least one section of each of a plurality of corresponding first capacitive patches of the first conductive layer. Each second capacitive patch may also comprise a plurality of sections which overlaps a section of one of the corresponding first capacitive patches. Each first capacitive patch may further comprise a loop and connections to connect neighboring sections of the first capacitive patch. Each first and second capacitive patch may have a substantially identical shape.

In a third embodiment, the FSS is modeled by an equivalent circuit having second Foster canonical form with a fundamental resonant frequency lower that of a second FSS consisting of a square lattice of Jerusalem crossed slots with a second period equal to the first period.

The first period may be at most 1/10 of a free space wavelength at the resonance frequency of the FSS.

The conductive layer may comprise a printed meanderline inductor. The meanderline inductor may comprise a printed spiral inductor and the conductive layer may further comprise a printed interdigital (comb-shaped) capacitor.

The conductive layer may comprise a structure having a plurality of length scales within one unit cell. Such a conductive layer may comprise a fan blade structure with a grid that delineates sections of a first and second area. The sections of a first and second area may each contain a plurality of smaller capacitive patches connected with the grid and having areas that depend on the area of the section.

The adjacent capacitive patches may be connected by an inductor having an inductance greater than the inductance of the straight line segment connecting the adjacent capacitive patches. The inductor may comprise a discrete inductor or a meanderline having a length substantially longer than a length of the straight line segment connecting the adjacent capacitive patches. The meanderline may be coplanar with or out of plane with the first conductive layer of capacitive patches.

The capacitive patches may comprise a single solid square, a cloverleaf, or a loop.

The adjacent capacitive patches may be connected through the straight line segment.

The first conductive layer may further comprise an inductive grid that surrounds the capacitive patches and the capacitive patches isolated from each other and the inductive grid.

In any of the above embodiments of the third embodiment, a second conductive layer of capacitive patches may be separated and isolated from the first conductive layer of capacitive patches and overlap a plurality of the capacitive patches of the first conductive layer.

In a fourth embodiment, the FSS comprises a first conductive layer having a periodic structure of capacitive patches and a second layer separated from the first conductive layer. The second layer is coupled to the first conductive layer such that one of an effective inductance and capacitance of an effective LC circuit that models electromagnetic characteristics of the FSS is substantially affected by presence of the second layer.

The period of the frequency selective surface may be at most 1/10 of a free space wavelength at the resonance frequency of the frequency selective surface.

The first conductive layer may comprise a printed meanderline inductor. The meanderline inductor may comprise a printed spiral inductor and the first conductive layer may further comprise a printed interdigital (comb-shaped) capacitor. The second layer may comprise capacitive patches each of which overlaps a plurality of the spiral inductors.

The capacitive patches may comprise a structure having a plurality of length scales. Such capacitive patches may comprise a fan blade structure with a grid that delineates sections of a first and second area. The sections of first and second area may each contain a plurality of smaller capacitive patches connected with the grid and having areas that depend on the area of the section. The second layer may comprise capacitive patches that overlap the smaller capacitive patches.

Adjacent capacitive patches may be connected by an inductor having an inductance greater than the inductance of a straight line segment connecting the adjacent capacitive patches. The inductor may comprise a discrete inductor or a meanderline having a length substantially longer than a length of the straight line segment connecting the adjacent capacitive patches. The meanderline may be coplanar with the first conductive layer of capacitive patches, out of plane with the first conductive layer of capacitive patches and the second layer, or the second layer may comprise the meanderline.

The capacitive patches may comprise a single solid square, a cloverleaf, or a loop.

Adjacent capacitive patches may be connected through a straight line segment.

The first conductive layer may further comprise an inductive grid that surrounds the capacitive patches and the capacitive patches isolated from each other and the inductive grid.

In any of the embodiments of the fourth embodiment, the second layer may comprise capacitive patches isolated from each other and the capacitive patches of the first conductive layer, the capacitive patches of the second layer separated from and overlapping a plurality of capacitive patches of the first layer.

In a fifth embodiment, the FSS comprises a single conducting layer having a periodic structure with a first characteristic length scale corresponding to an inductive grid and a second characteristic length scale corresponding to first capacitive patches, the first capacitive patches having at least two different sizes and each first capacitive patch being connected at a comer to a node of the inductive grid. The FSS may comprise an additional layer of second capacitive patches overlying the first capacitive patches and providing a capacitance that reduces a resonant frequency of the FSS without increasing a period of the periodic structure.

In other embodiments, methods of achieving desired results are disclosed, for example:

A method of reducing planar dimensions of a frequency selective surface having unit cells with an effective inductance-capacitance circuit of a first effective inductance in parallel with a series combination of an effective capacitance and a second effective parasitic inductance while retaining a frequency of electromagnetic waves propagating along the frequency selective surface is disclosed. The method comprises increasing the first effective inductance to substantially greater than an inductance of a straight line segment between the unit cells of the frequency selective surface and while not substantially increasing the second effective inductance.

A method of reducing planar dimensions of a frequency selective surface having an effective inductance-capacitance circuit of a first effective inductance in parallel with an effective capacitance while retaining a frequency of electromagnetic waves propagating along the frequency selective surface is disclosed. The method comprises increasing the effective capacitance by overlapping capacitive patches of a periodic structure forming the frequency selective surface with capacitive patches offset from the frequency selective surface by a predetermined amount.

A method of decreasing a lowest pole frequency of electromagnetic waves propagating along a frequency selective surface below 10 GHz is disclosed in which the method comprises connecting periodic first capacitive patches disposed on a conductive layer of the frequency selective surface through a meanderline disposed on a secondary layer.

A method of decreasing a lowest pole frequency of electromagnetic waves propagating along a frequency selective surface below 10 GHz is disclosed in which the method comprises isolating periodic capacitive patches disposed on a first conductive layer of the frequency selective surface from other elements and periodic capacitive patches on a second conductive layer, isolating the patches on each layer from other patches on the same layer and from other patches on the other layer, and overlapping the patches on different layers.

A method of decreasing a lowest pole frequency of electromagnetic waves propagating along a frequency selective surface below 10 GHz is disclosed in which the method comprises connecting periodic capacitive patches disposed on a first conductive layer of the frequency selective surface with each other, isolating periodic capacitive patches on a second conductive layer from other patches on the second conductive layer and the patches of the first conductive layer, and overlapping the patches on the first and second conductive layers.

DETAILED DESCRIPTION OF PREFERRED EMBODIMENTS

The frequency selective surfaces (FSS) in the embodiments below are electrically-thin, periodic, printed circuit boards. A FSS may be formed from a multi-layer printed circuit board, not just a single thin layer of metal, or just a single layer of metal etched on a dielectric layer. In currently pending patent application Ser. No. 09/678,128 filed Oct. 4, 2000 and entitled "Multi-resonant High-Impedance Electromagnetic Surfaces," herein incorporated by reference, Diaz and McKinzie teach that electrically thin FSS structures can be accurately modeled, in general, with effective sheet admittance Y(ω) using the second Foster canonical form as an equivalent circuit:

$$Y(\omega) = j\omega C_0 + \frac{1}{j\omega L_0} + \sum_{n=1}^{N} \frac{1}{R_n + j\omega L_n + \frac{1}{j\omega C_n}}$$

Figure 1:
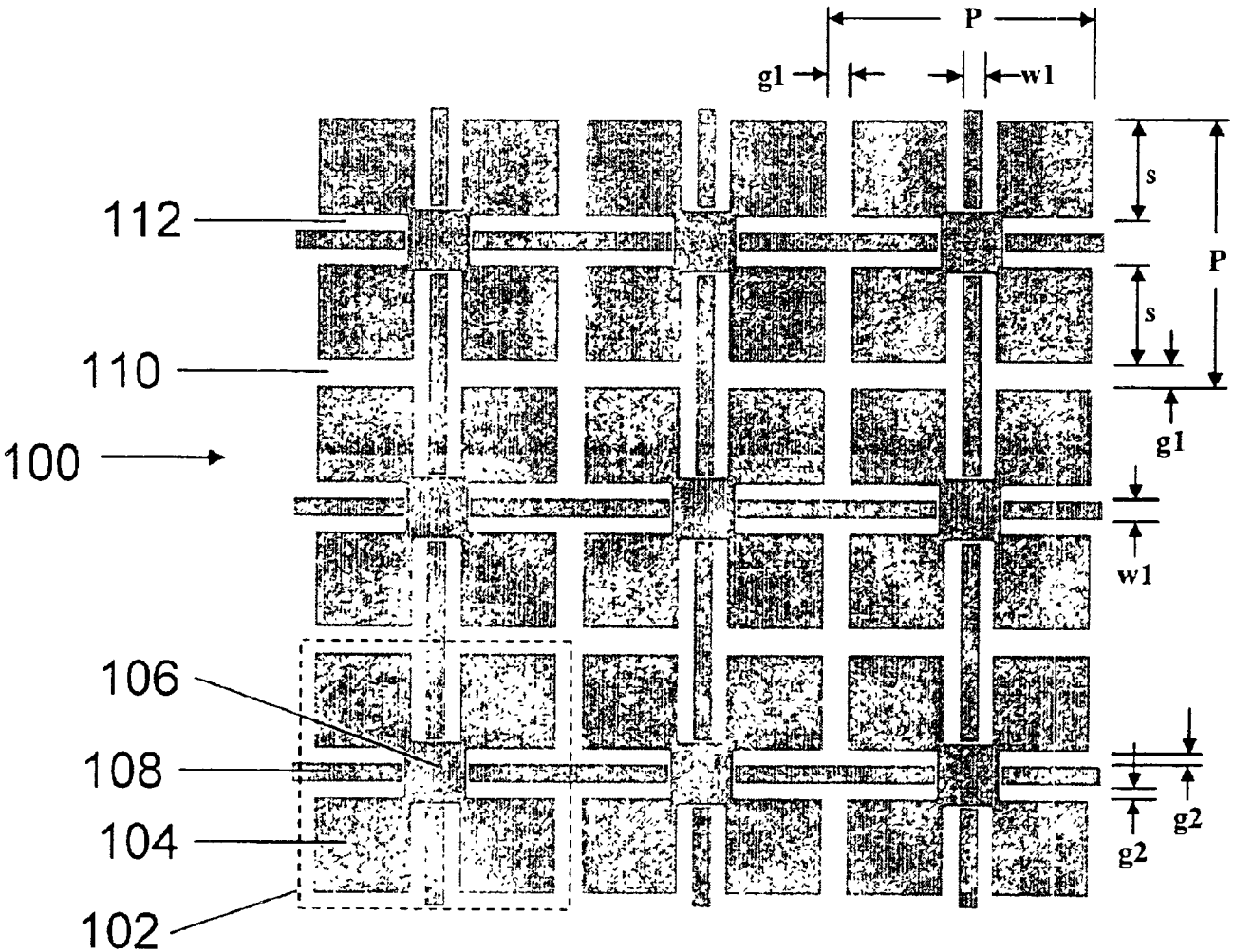
Fig. 1 Prior Art
FIG. 1 is a top view of a conventional UC-PBG FSS.
Figure 2A:
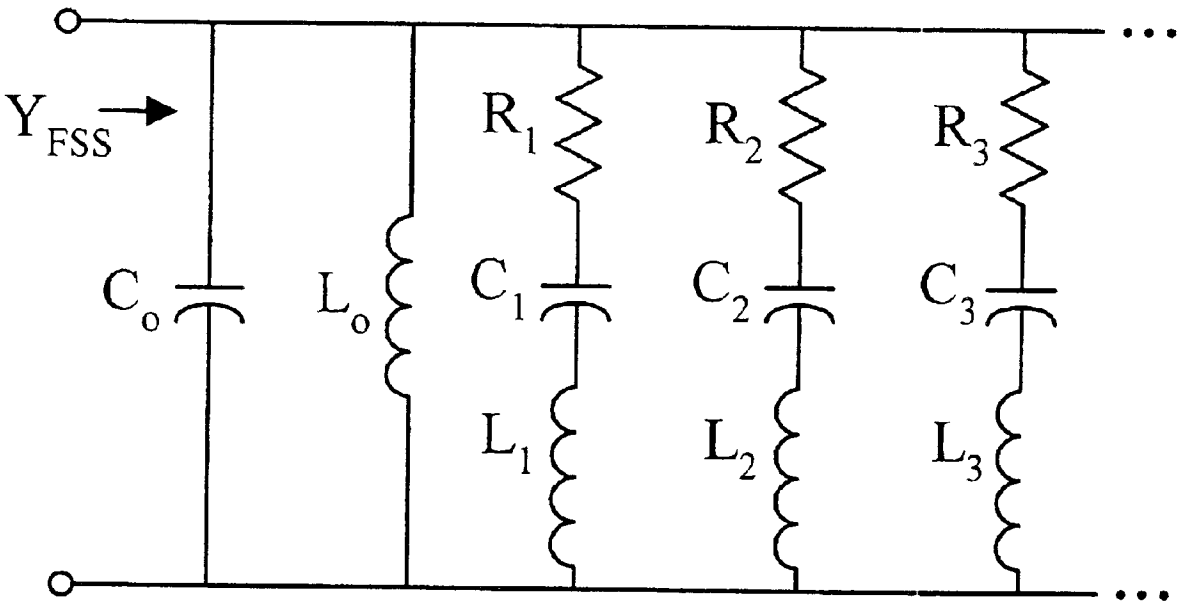
FIGS. 2*a–c* illustrate equivalent circuits of a DCL FSS.

This admittance function, Y(ω), is related to the FSS sheet capacitance ($C=\epsilon_{1r}\epsilon_0 t$) by the relation $Y=j\omega C$. The corresponding equivalent circuit is shown in FIG. 2*a*. Each series RLC branch manifests an intrinsic higher order resonance of the FSS. For an FSS made from low loss materials, $R_n$ is expected to be very low, hence resonances are expected to be Lorentzian. A Lorentz resonance is characterized by the effective sheet capacitance becoming infinite in magnitude, and changing it sign at the Lorentz resonant frequency. Every series RLC branch models a separate Lorentz pole for the admittance function.

Not every FSS will require all the circuit elements of the second Foster canonical form to accurately describe its performance. However, by definition, all DCL FSS structures must include the inductor $L_0$ in their model. This is because, in the low frequency limit, the FSS equivalent circuit must be inductive. The Lorentz poles (series RLC branches) are not necessarily required in a DCL FSS.

Figure 2B:
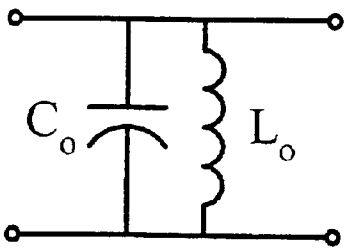

The circuit element $C_0$ is the high frequency limit for shunt capacitance. In many DCL FSS embodiments only $L_0$ and $C_0$ are needed to accurately model the FSS, such as shown in the schematic of FIG. 2*b*. In this case, there is a zero in the admittance function, or a pole in the impedance function, at $\omega=1/\sqrt{L_0C_0}$. For another equivalent circuit, shown in FIG. 2*c*, the pole in the impedance function resides at $\omega=1/\sqrt{(L_0+L_1)C_0}$. The pole in the impedance function is also called the fundamental resonance, or the fundamental pole frequency.

The fundamental pole frequency for a DCL FSS can be determined by inspection of transmission plots were the lowest frequency transmission peak is observed for normal incidence. Assuming the equivalent circuit of FIG. 2*b*, the 3 dB transmission bandwidth, $BW_{3\ db}$, permits calculation of the capacitance $C_0$ using $C_0=1/(\eta_0\pi BW_{3dB})$ where $\eta_0=377\Omega$ is the impedance of free space. The inductance $L_0$ can then be readily calculated from $\omega=1/\sqrt{L_0C_0}$.

Physical embodiments of a low frequency enhanced DCL FSS and related applications are discussed below. One purpose of a low frequency enhanced DCL than at X band and above.

Figure 2C:
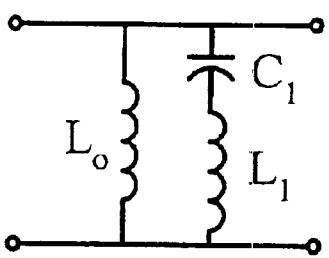
Figures 3A, 3B:
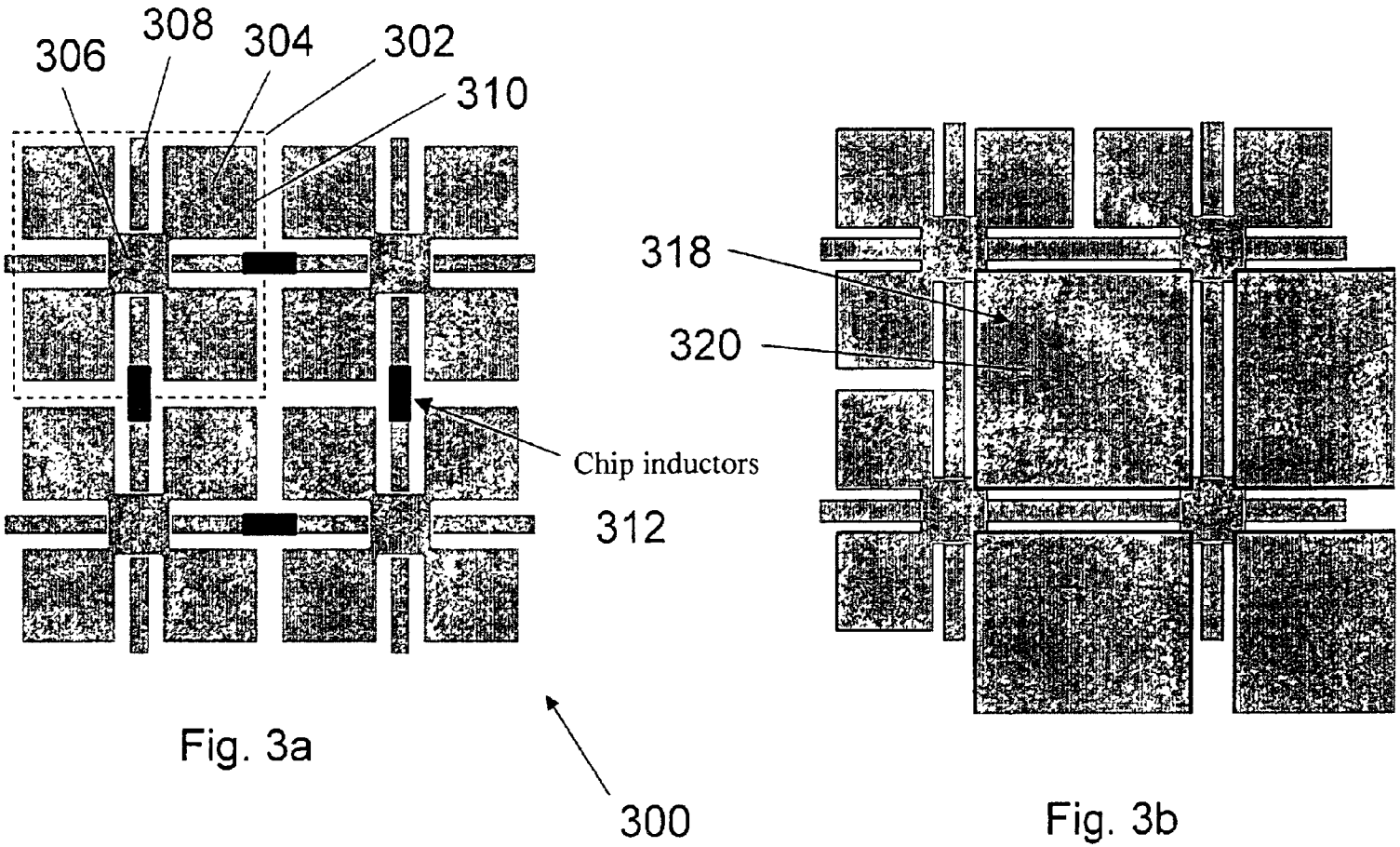
FIGS. 3*a* and *b* are top views of different embodiments for DCL FSS.

A first embodiment of such a DCL FSS is shown in FIG. 3*a*. In this FSS 300, the effective inductance $L_0$ of the conventional Jerusalem cross slotted FSS structure is increased with the addition of surface mounted chip inductors. The conductive layer 300 thus contains unit cells 302 formed by a cloverleaf pattern with four petals (also called Cohn squares) 304 and a center 306. The conductive layer also contains straight line segments 308 forming an inductive grid by connecting adjacent centers 306 at substantially the middle of the edge of the center 306. A gap 310 separates adjacent capacitive patches 304. Another way to describe this is a simple square shape with notches cut into the center of the edges of the squares and straight line segments disposed in the notches. The effective sheet inductance is formed by the grid of straight line segments 308 as well as the connections between the petals 304 and the center 306 of the cloverleaf 302. Discrete inductors 312 are placed in series with the straight line segments 308 to increase the inductance of these segments 308. The DCL FSS has an equivalent circuit denoted by FIG. 2*c*.

Note that although a capacitive patch is shown in the FIG. 3*a*, for example, as a simple square, other shapes are possible to achieve the desired capacitance. Shapes can include, but are not limited to, quadrilateral, rectangular, hexagonal, circular, ovate, or parallelepiped shapes, a loop, interdigital fingers, and inductive spirals, or any combination thereof.

Alternatively, the addition of the discrete inductors may not be desirable to decrease the resonant frequency and establish the desired low frequency. Reviewing the effective circuit diagram of FIGS. 2*b* and 2*c*, the resonant frequency may also be decreased by increasing the effective capacitance. In the embodiment of FIG. 3*a*, the effective capacitance is essentially formed by the edge-to-edge capacitive coupling between the adjacent petals 304 of the unit cell 302. To increase the edge-to-edge capacitive coupling, the length of the edges of the capacitive patches 302 may be increased. However, if the edges of the capacitive patches 302 are increased, the area of the capacitive patch 302 is increased and overall the size of the layer increases.

Thus, another technique to increase the capacitive coupling between capacitive patches is to employ an out of plane conductive layer; that is, a second conductive layer of capacitive patches that overlaps the patches on the first conductive layer such that a significant parallel plate capacitance is achieved that links the adjacent capacitive patches 304. The second layer of patches increases $C_0$, but does not block the magnetic flux that passes through the slots next to the inductive grid. This is illustrated in FIG. 3*b*, in which the second layer of patches 318 contains capacitive patches 320 that have substantially the same dimensions and period as the patches 302 of the first layer 300. Each capacitive patch 320 in the second conductive layer 318 overlaps four petals 304, each petal 304 in an adjacent unit cell 302 on the first conductive layer 300.

The patches 320 of the second layer 318 are not required to have any particular shape, the important feature being the overlap area of the underlying first layer of patches 302 by the overlying area of the second layer of patches 320. Thus, for example, in another embodiment the overlapping second layer of patches may be formed from the same printed circuit structure as the first layer of patches, for example a cloverleaf structure whose petals overlap petals of the underlying first layer of patches and whose center and straight line segments are disposed essentially in between the cloverleaf patches of the underlying first layer of patches. An FSS dielectric spacer layer (not shown) having a relatively low permittivity separates the underlying first layer of patches 302 and the overlying second layer of patches 320 such that a parallel plate capacitance is formed between the first and second sets of patches 302 and 320. This capacitive coupling is enhanced by the dielectric constant of the printed circuit material.

Figure 4B:
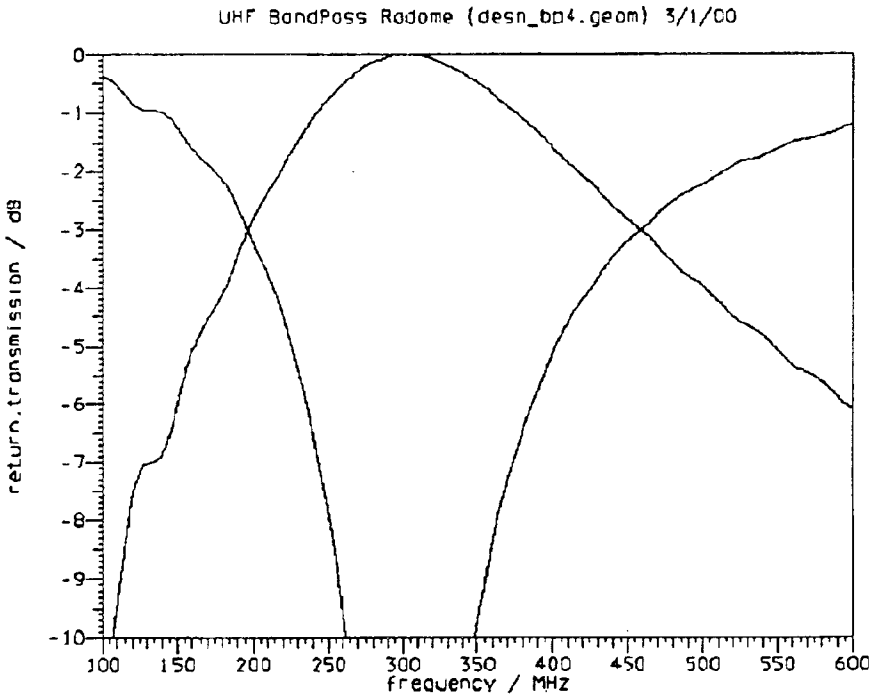
FIGS. 4*a* and *b* are a top view of another embodiment, used as a bandpass filter, and a plot of the transmission and return loss of this embodiment.
Figure 4A:
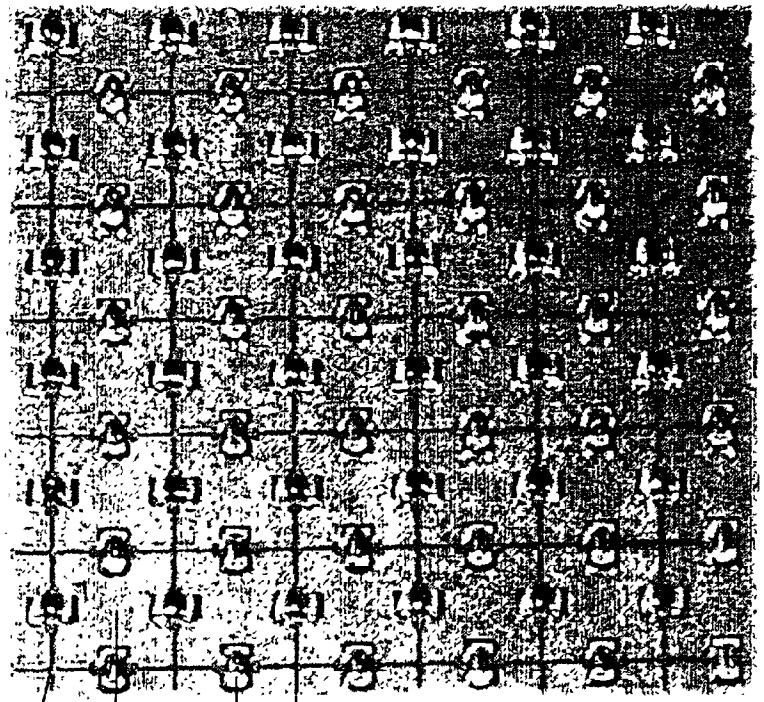

Of course, both the addition of the surface mounted inductor and the second layer of overlapping patches can be used separately or in combination to reduce the fundamental resonant frequency. One caveat for such an embodiment, however, is that the chip inductor should have a self-resonant frequency much higher than the intended resonant frequency of the DCL FSS to be an effective inductor. An embodiment of such a DCL FSS is shown in FIG. 4*a*. In this embodiment, the FSS 400 contains an upper layer of capacitive patches 402 that are simple solid squares of conductive material, such as metal. These capacitive patches 402 are connected to adjacent squares by surface mounted chip inductors 404 disposed substantially in the center of each edge. The capacitive patches 402 are separated by a gap 406. An underlying second layer of square capacitive patches (not shown) are disposed below the overlying first layer of capacitive patches 402 in the same manner as the structure shown in FIG. 3*b*. The first and second layers of capacitive patches are likewise separated by a FSS dielectric 408.

In this embodiment, the notches that convert each solid patch into a cloverleaf have been eliminated since the inductance that the notches add is insignificant compared to the value of surface mounted inductor. In a realized FSS of FIG. 4*a*, the center frequency, or resonant frequency, may be selected to be about 300 MHz. Plots of normal incidence plane wave transmission and return loss of such a realized FSS are shown in FIG. 4*b*. The FSS has a period that is substantially smaller than the free space wavelength at resonance (here $\lambda/145$). The particular design from which the plots originate used 82 nH Coilcraft inductors of the 0805HT series. The FSS used 260 mil overlapping patches on a period of 270 mils, i.e. the gap between the squares was 10 mils. Two dielectric layers of 8 mil Rogers R04003 were used, one to separate layers of patches and the other disposed under the underlying layer of patches. Measurements were made using a plane wave transmission and reflection test over a frequency range sufficient to identify the fundamental resonant frequency.

Figure 5:
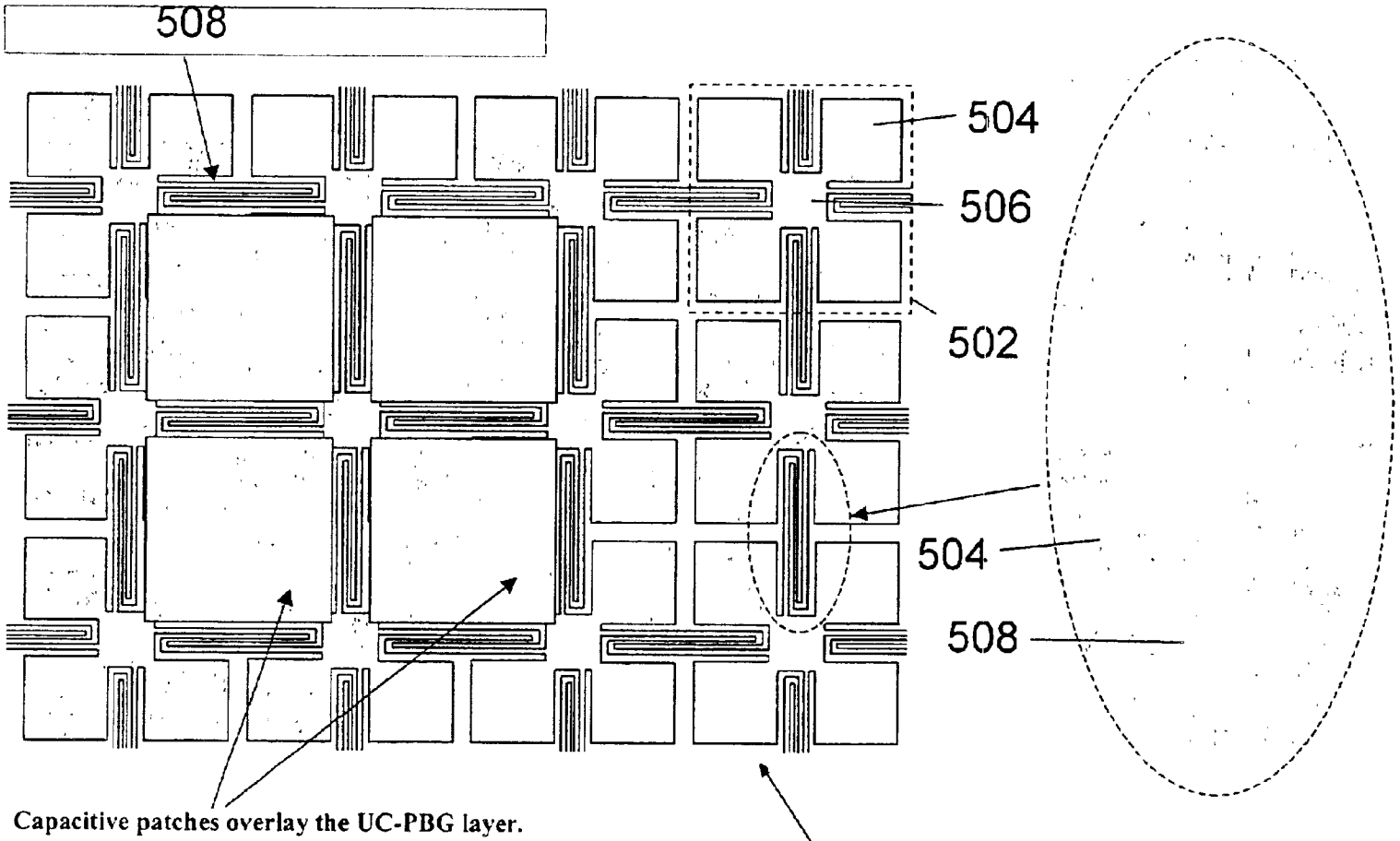
FIG. 5 illustrates a top view of another low frequency embodiment of a DCL FSS.

However, although chip inductors are very effective at lowering the resonant frequency, their cost may be prohibitive for commercial applications. It would be desirable to have a printed inductor that connects the patches. To this end, rather than connecting adjacent patches with merely a straight line segment, a meanderline (also called meanderline inductor) may be used as the inductance between the adjacent patches. Note that the meanderline inductance increases with physical length. The meanderline is essentially merely a non-straight line conductive path between adjacent patches. Like the above embodiments using a chip inductor, embodiments with a meanderline inductor may be a single, planar structure that rely on edge-to-edge capacitance, or it may rely on overlapping capacitive patches to lower the fundamental resonant frequency. An embodiment of the latter type of FSS is shown in FIG. 5. In this FSS 500, solid conductive patches 520 overlap the petals 504 of the underlying cloverleaf unit cell pattern 502 and adjacent centers 506 of the cloverleaf unit cell patterns 502 are connected by coplanar meanderlines 508. The solid conductive patches 520 and cloverleaf patterns 502 are separated by a FSS dielectric (not shown).

Before illustrating further examples of such a DCL FSS structure, one method of designing these structures will be discussed. In the process of designing DCL FSS structures to operate at low microwave frequencies of 2 GHz or less, the equivalent circuit of the conventional UC-PBG was inadequate to model the FSS embodiments, including any derivatives with coplanar meanderline inductors. For example, the prior art does not teach that an inductance is needed in series with the shunt capacitance $C_0$ to account for the presence of the notches in each patch, as shown in FIG. 2*c*, which shows a more complete equivalent circuit topology including the notch inductance modeled as $L_1$. The notch inductance, in fact, can be 10% or more of the grid inductance $L_0$.

Figure 6B:
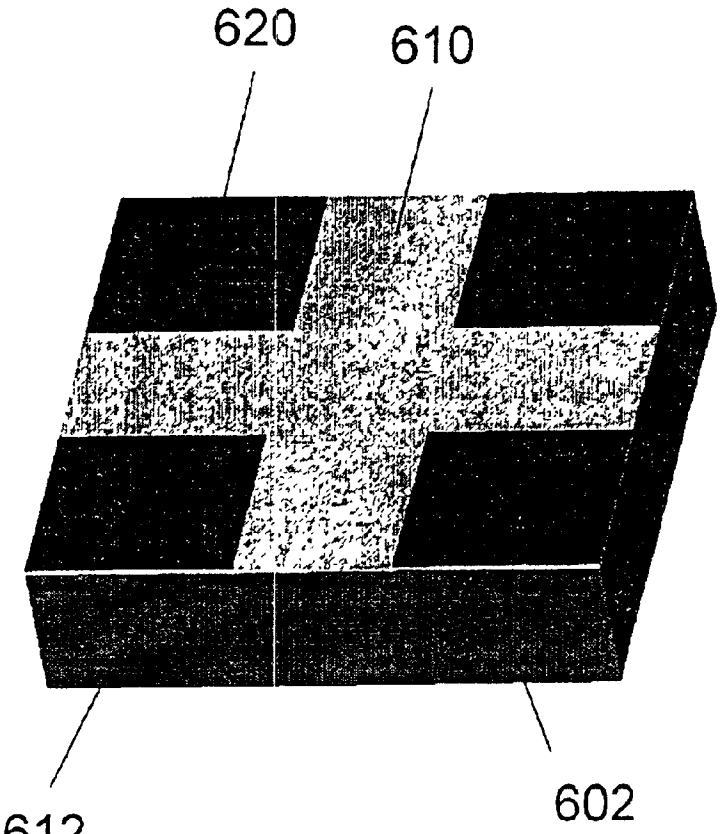
FIGS. 6*a* and *b* illustrates top and cross-sectional views of another embodiment of a DCL FSS.
Figure 6A:
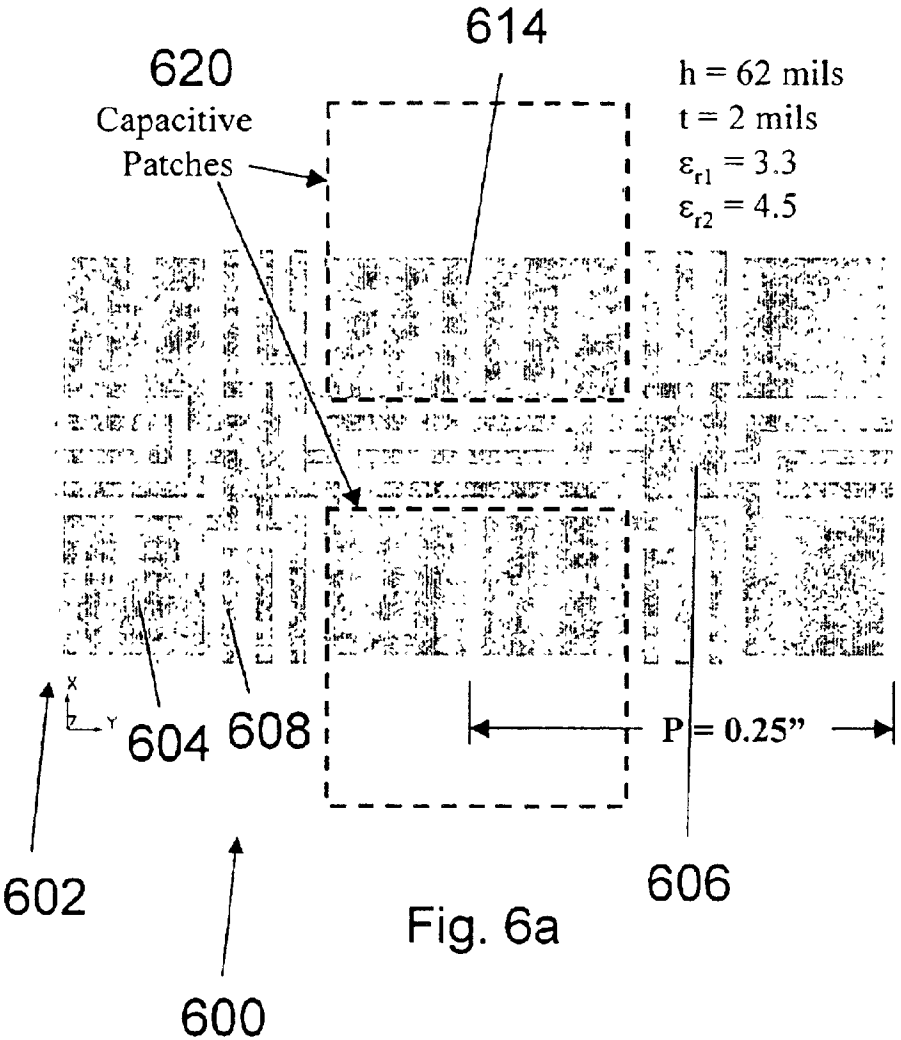

The top and cross-sectional views of another embodiment of a DCL FSS are shown in FIGS. 6*a* and 6*b*. In FIG. 6*a*, the upper layer of patches (solid squares) 620 are shown as dashed lines and the dielectric layer 610 between the upper conductive layer of patches 620 and the lower conductive layer of patches 602 (cloverleaf with meanderline) are shown as a solid layer. The patches 602 of the lower conductive layer have petals 604 and a center 606. The centers 606 of adjacent patches 602 are connected through the meanderline 608. The upper and lower conductive layers of patches 602 and 620 are separated by a FSS dielectric layer 610 and a dielectric spacer 612 is disposed beneath the lower conductive layer of patches 602.

The period of each of the upper and lower array of patches is 250 mils, gaps between these patches (without the meanderline between the patches) 614 as well as line widths of the meanderline are each 10 mils. The cross-sectional view of a unit cell of the embodiment is illustrated in FIG. 6*b*, which shows a top layer of capacitive patches 620 printed on a thin (2 mil) layer of polyimide ($\in_r$~3.5) as the FSS dielectric 610. A thicker (62 mil) lower dielectic spacer of FR4 ($\in_r$~4.5) is disposed below the second layer of capacitive patches 602.

In an artificial magnetic conductor (AMC), a ground plane is separated from the FSS. Typically, capacitive patches on at least one conductive layer of the FSS are connected to the ground plane through support posts (vias). Thus, the separation between the FSS and the ground plane may be realized by air or the lower dielectric spacer 612.

The presence of the notch inductance in the UC-PBG, and related DCL FSS designs, has a deleterious effect on reflection phase bandwidth when the DCL FSS is placed near the ground plane and used as a high-impedance surface. Our research indicates that any DCL FSS design using a coplanar meanderline can offer at best only 50% of the ±90° reflection phase bandwidth achievable from a Sievenpiper type high-impedance surface. One way to avoid this is to move the inductive grid that connects the capacitive patches of a particular conductive layer out of plane relative to that conductive layer as well as out of plane of any conductive layer within the DCL FSS that contains capacitive patches. This eliminates the notch inductance from the equivalent circuit model and increases the reflection phase bandwidth.

Figures 7A, 7B:
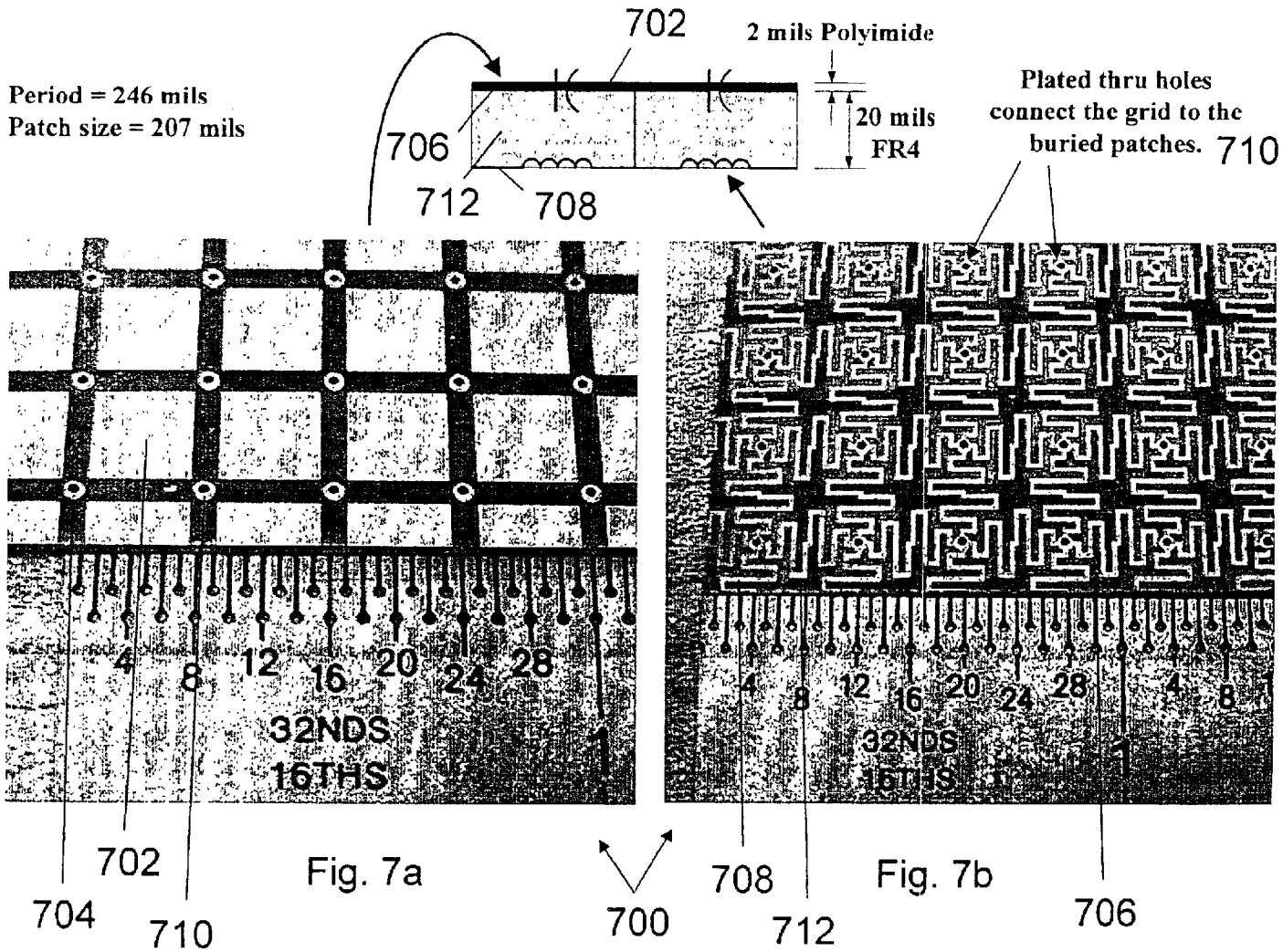
FIGS. 7*a* and *b* illustrates top and bottom views of a multi-layer embodiment for a DCL FSS.

One embodiment for a low-frequency enhanced DCL FSS employing an out-of-plane inductive grid is shown in FIGS. 7*a* and 7*b*. Given a period of 250 mils, this embodiment can have a fundamental resonance at 600 MHz, for example. This FSS 700 contains square capacitive patches 702 printed on one side of a 2 mil FSS dielectric (polyimide) 704. A lower layer of capacitive patches (buried layer) 706 is disposed on the opposing side of the FSS dielectric 704. The buried layer of patches 706 is attached to a 20 mil layer of FR4 (dielectric spacer 712). The inductive grid 708 of 10 mil wide meanderline is disposed on a surface opposing the buried layer of patches 706. The meanderline 708 has a period of 250 mil period, the same period as the layers of capacitive patches 702 and 706. At the intersection of each meanderline 708, a plated through hole 710 connects the inductive grid 708 to the center of one of the buried patches 706.

The equivalent circuit of such a structure is shown in FIG. 2*b*. In one example, the LC values are 11 nH/square and 2.4 pF/square, yielding a fundamental resonance near 1 GHz. As shown, the period of the various conductive layers may be as small as $\lambda/48$ at resonance. No surface mounted components are needed in this embodiment, only a hybrid flex-rigid board with three metal layers and two dielectric layers.

Figure 8:
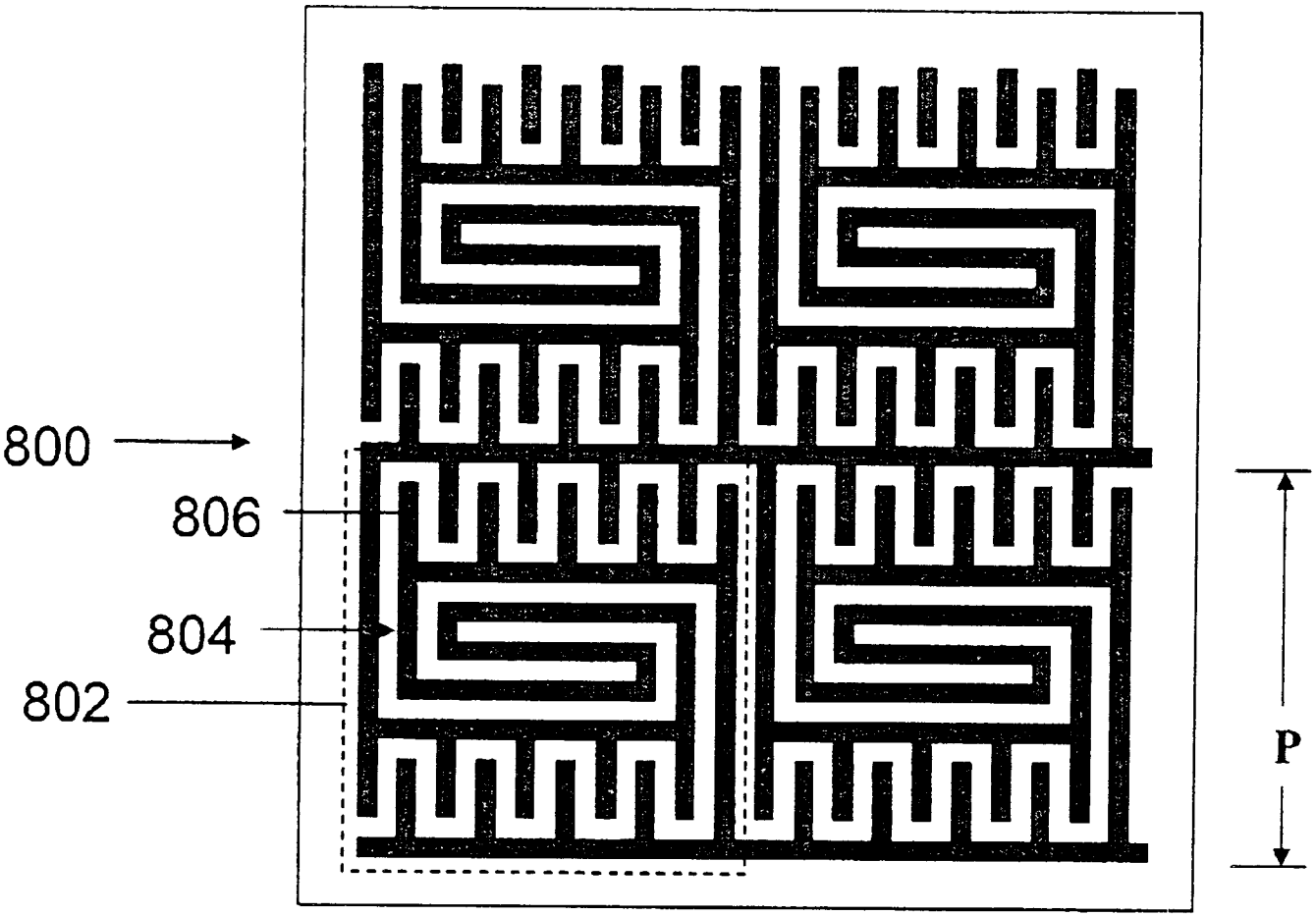
FIG. 8 shows a top view of another embodiment of a DCL FSS employing a single conductive layer.

A similar technique may be employed to form various inductive grids as single or dual layer DCL FSSs without use of a buried inductive grid. In this case, spirals or spirals combined with interdigital capacitors may be used. One embodiment of such an FSS 800 is shown in FIG. 8. As can be seen, the unit cell includes a meanderline inductor 804 as well as fingers 806 that form interdigitated capacitors. The embodiment shown is a single layer structure with no overlapping patches (although they may be added as above). The meandering pattern increases the inductance, while the fingers 806, which extend from the meanderline, form interdigitated capacitors that increase the capacitance.

Figures 9A, 9B:
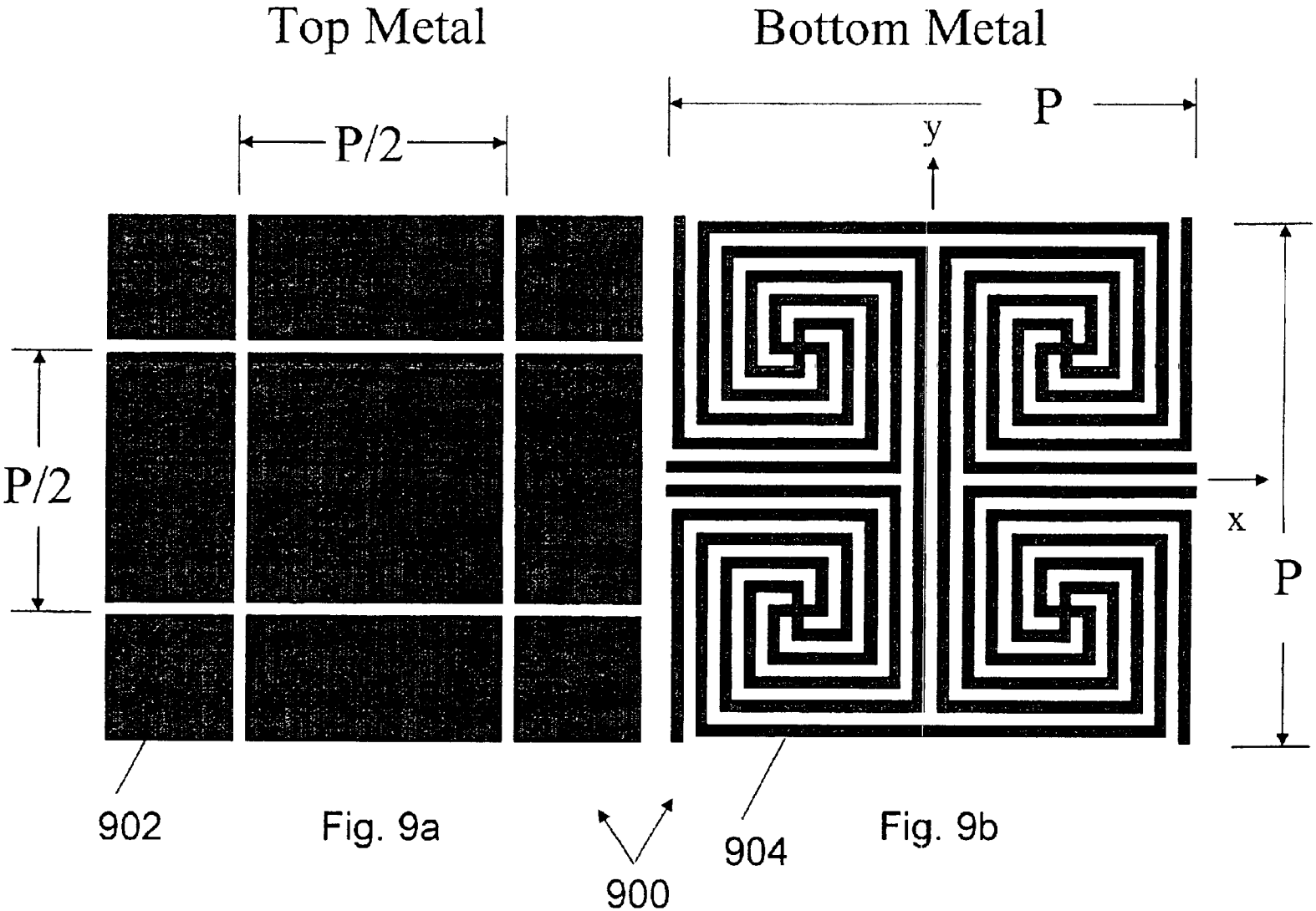
FIGS. 9*a* and *b* illustrate top views of upper and lower conductive layers of another embodiment of a DCL FSS.

FIGS. 9*a* and 9*b* show the layers of another embodiment employing the above concept. In this FSS 900, the capacitive patches 902, and the spiral inductor 904, are printed on opposite sides of an FSS dielectric (not shown), such as a conventional printed circuit board. A two conductor layer structure whose layers have the same period thus results: the upper layer square patches 902 are separated from the lower layer spirals 904 by the FSS dielectric. As in the other two layer embodiments, the upper layer square patches 902 overlap a section of adjacent spirals 904 such that the capacitance and inductance of the FSS 900 are modeled as in FIG. 2*b*.

Figures 10A, 10B:
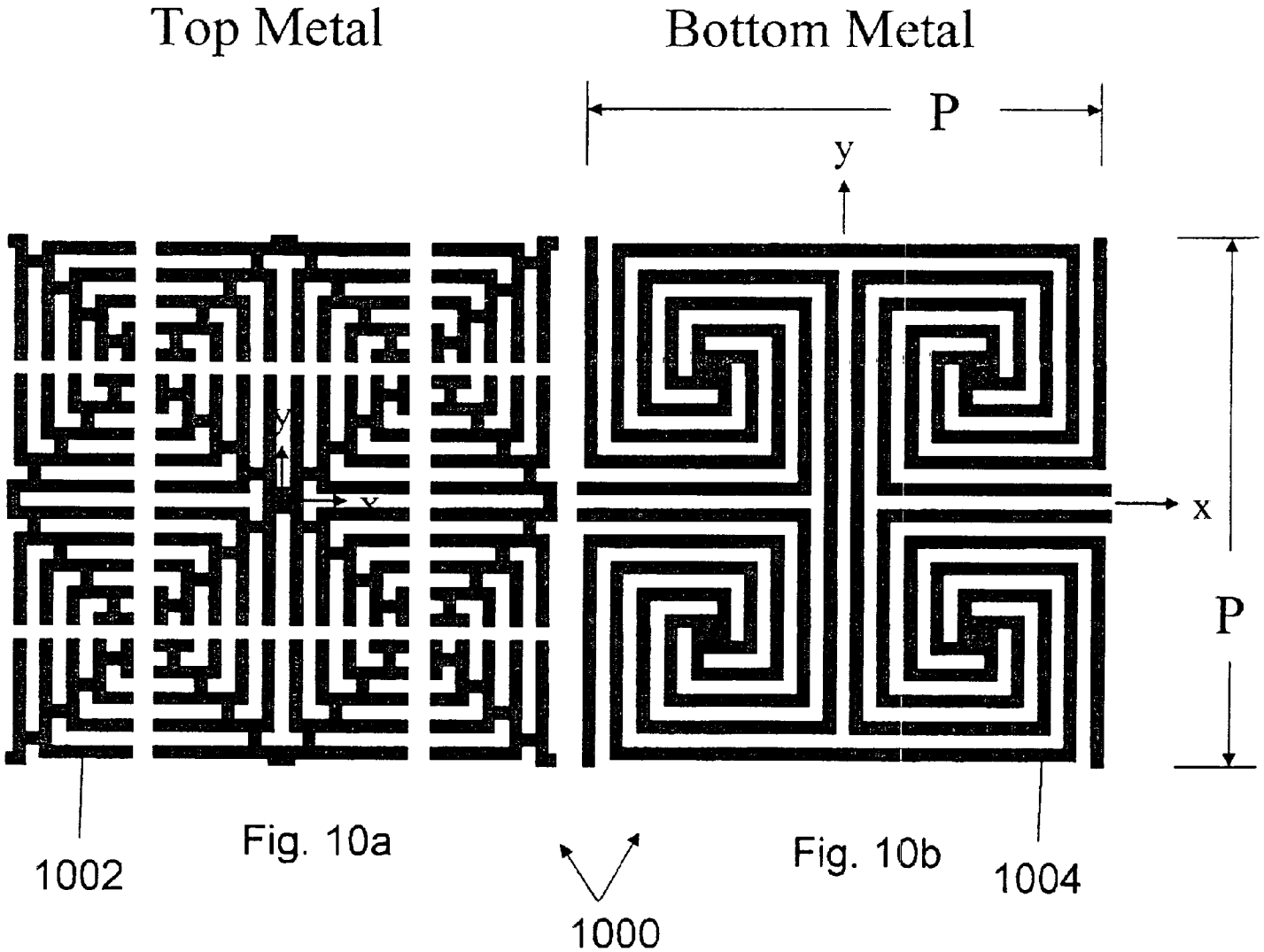
FIGS. 10*a* and *b* illustrate top views of upper and lower conductive layers of another embodiment of a DCL FSS.

However, as shown in the FSS 1000 of FIG. 10, while the spirals 1004 of the lower layer remain substantially the same, the patches 1002 of the upper layer do not have to be solid squares. By altering the upper layer capacitive patches 1002 to emulate tree branches as shown, the inductance of the patches 1002 may be increased while the parallel plate capacitance formed with the spirals 1004 remains substantially the same. The parallel plate capacitance will remain substantially the same so long as the overlap between the material that forms the different patterns remains the same.

In addition, while the above DCL FSS structures are described as being disposed on a rigid or flex-rigid printed circuit structures, it is possible to fabricate DCL FSS structures from flexible substrates alone.

Other embodiments include printing the structure on a single layer but isolating the inductive grid from the patches. Some of the embodiments are shown in FIGS. 11–14. In these embodiments, the inductive grid of the DC inductive FSS structures is not directly connected to any of the metal islands which constitute the capacitive patches of the FSS. Thus, the capacitive patches are fully isolated, i.e. isolated from the inductive grid and from other capacitive patches on the same plane. A variety of LC patterns can be integrated on the first layer, or added as a second layer, to supply Lorentz poles for the transverse permittivity. The DC isolated grid allows a control voltage or a control current to support integrated electronics. Prime power can be supplied via this grid.

Figure 12:
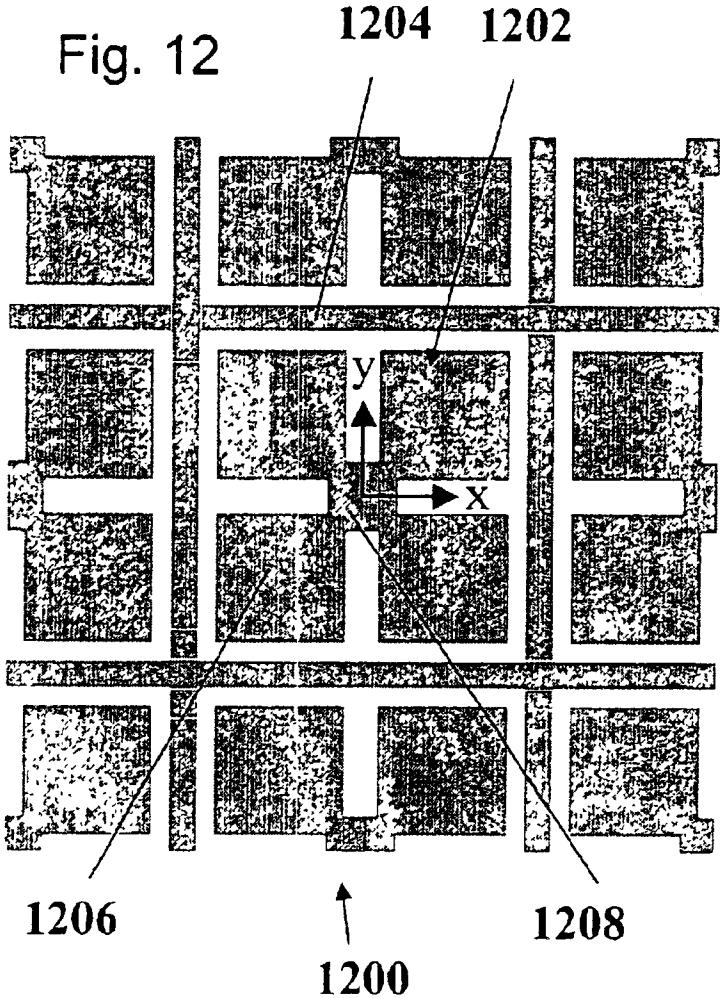
FIG. 12 shows a top view of another embodiment of a DCL FSS.
Figure 11:
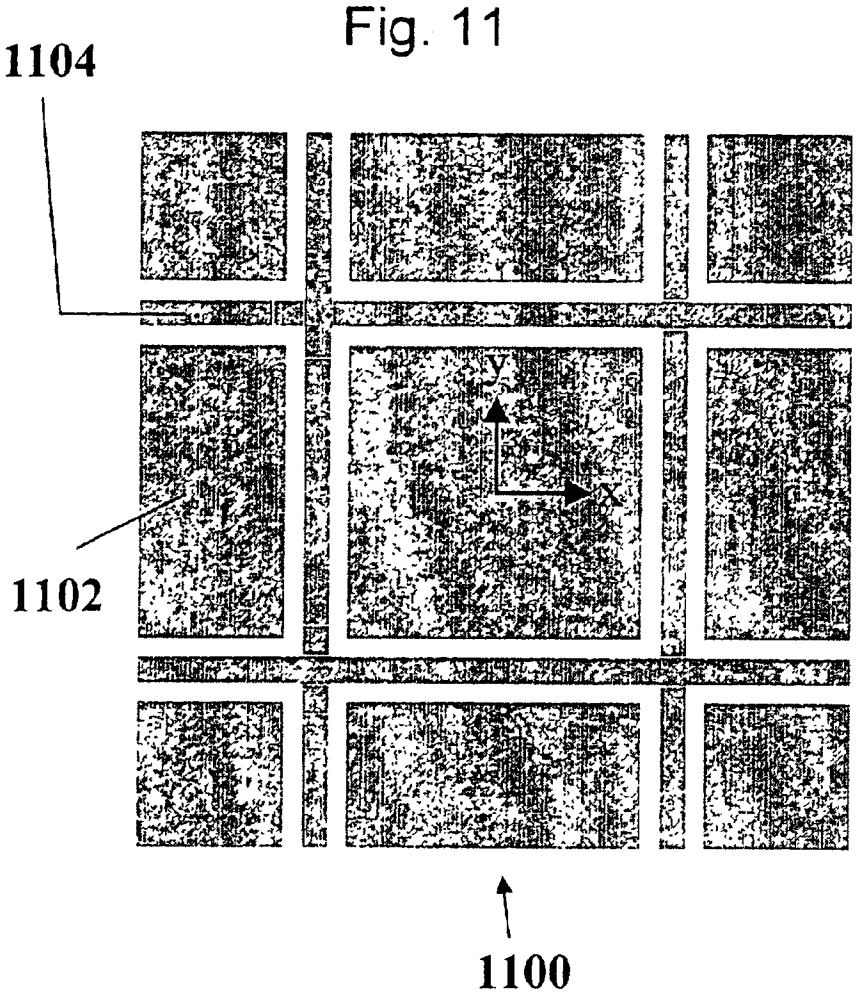
FIG. 11 shows a top view of another embodiment of a DCL FSS.

As shown in the FSS 1100, 1200 of FIGS. 11 and 12, the inductive grid 1104, 1204 may be a set of straight lines while the capacitive patches 1102, 1202 disposed between intersections of the inductive grid 1104, 1204 may be solid conductive squares 1102 or cloverleaf patterns 1202 (each cloverleaf 1202 having petals 1206 and a center 1208 unconnected with adjacent cloverleaf centers). The effective circuit diagrams are illustrated in FIG. 2*b*.

Similar to previous embodiments, a set of overlapping capacitive patches may be added to increase the capacitance. Examples of these embodiments are shown in FIGS. 13*a*–*c* and 14*a*–*c*. These figures illustrate the individual lower conductive layer 1302, 1402 and upper conductive layer 1304, 1404 of an FSS 1300, 1400 as well as the overall combination 1306, 1406 of the lower conductive layer 1302, 1402 and upper conductive layer 1304, 1404. As in embodiments including overlapping patches previously described, the overlapping patches of the upper layer in these figures overlap a plurality of patches of the lower conductive layer with an FSS dielectric (not shown) disposed between the lower conductive layer 1302, 1402 and upper conductive layer 1304, 1404.

Figures 13A, 13B, 13C:
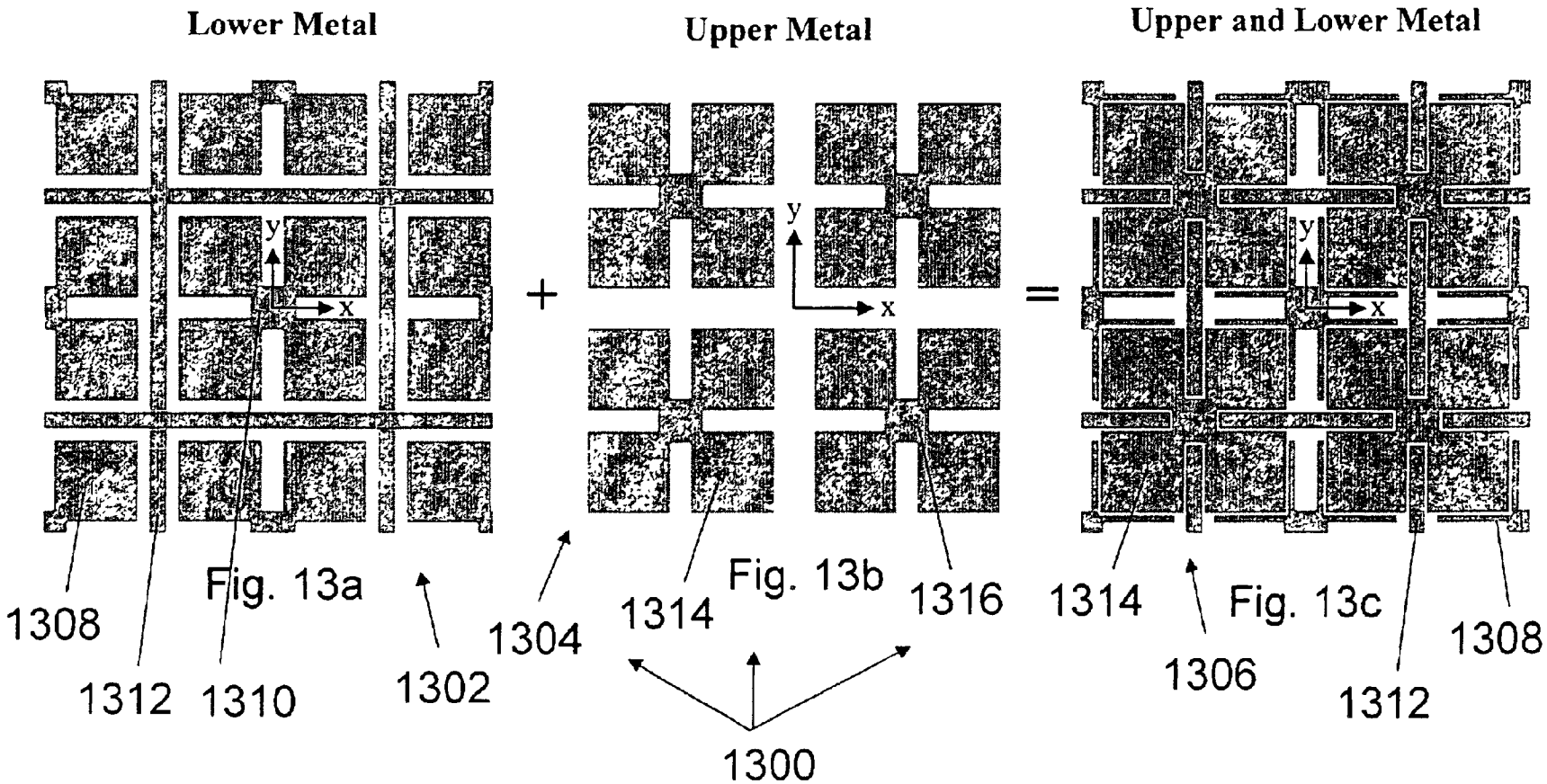
FIGS. 13*a–c* illustrate top views of upper and lower conductive layers of another embodiment of a DCL FSS as well as the combination of the upper and lower conductive layers of the embodiment.

FIGS. 13*a–c* illustrate an embodiment in which the petals 1308 of the cloverleaf of the upper layer 1304 overlap petals 1314 of the cloverleaves of the lower layer 1302 to form the parallel plate capacitance of FIG. 2*c*. Only the center 1316 of the cloverleaf of the upper layer 1304 overlaps the inductive grid 1312 of the lower layer 1302. The center 1310 of the cloverleaf of the lower layer 1302 is not overlapped.

Figures 14A, 14B, 14C:
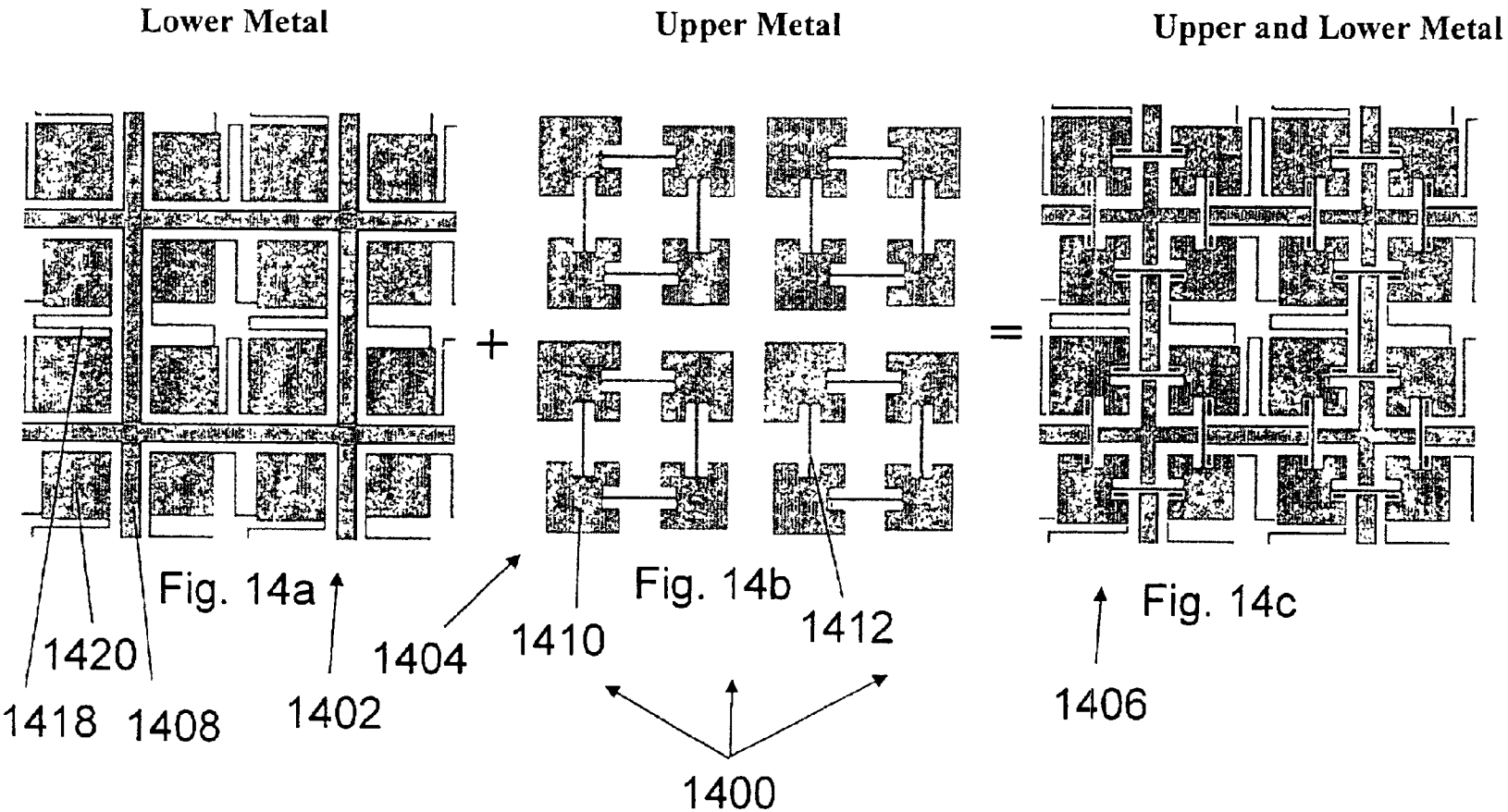
FIGS. 14*a–c* illustrate top views of upper and lower conductive layers of another embodiment of a DCL FSS as well as the combination of the upper and lower conductive layers of the embodiment.

In all of the previous embodiments, the capacitive patches and/or inductive grid have been fully symmetric around the center of the patch. This is not necessary however, as shown in FIGS. 14*a–c*. FIGS. 14*a–c* illustrate an embodiment in which the capacitive patches 1414 of the lower layer 1402 and the capacitive patches 1416 of the upper layer 1404 are non-symmetric. Both the capacitive patches 1414 of the lower layer 1402 and the capacitive patches 1416 of the upper layer 1404 have sub-patches 1420, 1410 of different sizes within a given unit cell. The sub-patches 1420 of the lower layer 1402 substantially match the sizes of the sub-patches 1410 of the upper layer 1404. The sub-patches 1420 of the lower layer 1402 are connected to each other through meanderlines 1418 of different lengths, while the sub-patches 1410 of the upper layer 1404 are connected to each other through straight lines segments 1412 of the same length. The loops formed by the capacitive patches 1414 of the lower layer 1402 and the capacitive patches 1416 of the upper layer 1404 increase the self-inductance of the patches.

Figure 15:
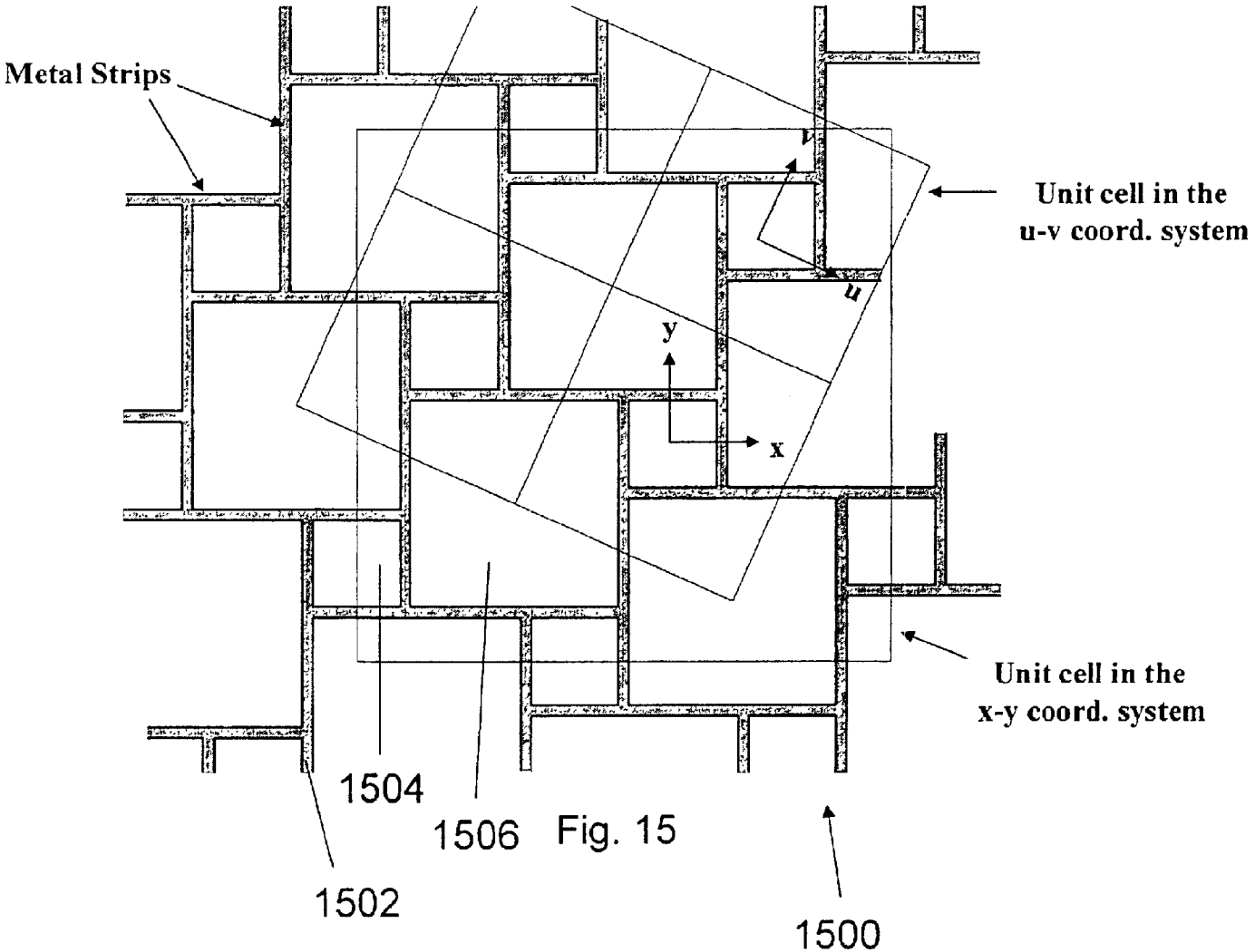
FIG. 15 illustrates a top view of another embodiment of a DCL FSS.

Another set of embodiments incorporates dual scale UC-PBG designs. This is a class of DCL FSS in which the inductive grid has two length scales, whose ratio may be varied continuously in design. Like the UC-PBG, this structure is coplanar (one metal layer), thereby having cost advantages compared to multi-layered FSS approaches, while also being expected to offer the advantage of a multi-resonant behavior for transverse permittivity. At least one Lorentz pole is expected in the analytic function for transverse permittivity. The penalty is a larger period size. Examples of such structures are shown in FIGS. 15 and 16. As can be seen in the simple fan blade structure of the FSS 1500 FIG. 15, a unit cell contains patterns formed using essentially the same pattern with two different sizes. As shown, the unit cell is defined using coordinate axes, x-y or u-v, tilted at a particular angle from the x-y axis. Unlike the conventional FSS layers using fan blades, the embodiment shown in FIG. 15 features an inductive grid of fan blades that are connected, not a capacitive grid of isolated fan blades. The fan blades are rotationally symmetric with four fold discrete symmetry, and the inductive grid 1502 that forms the fan blades delineate squares of a first area 1504 and squares of a second area 1506.

Figures 16A, 16B, 16C:
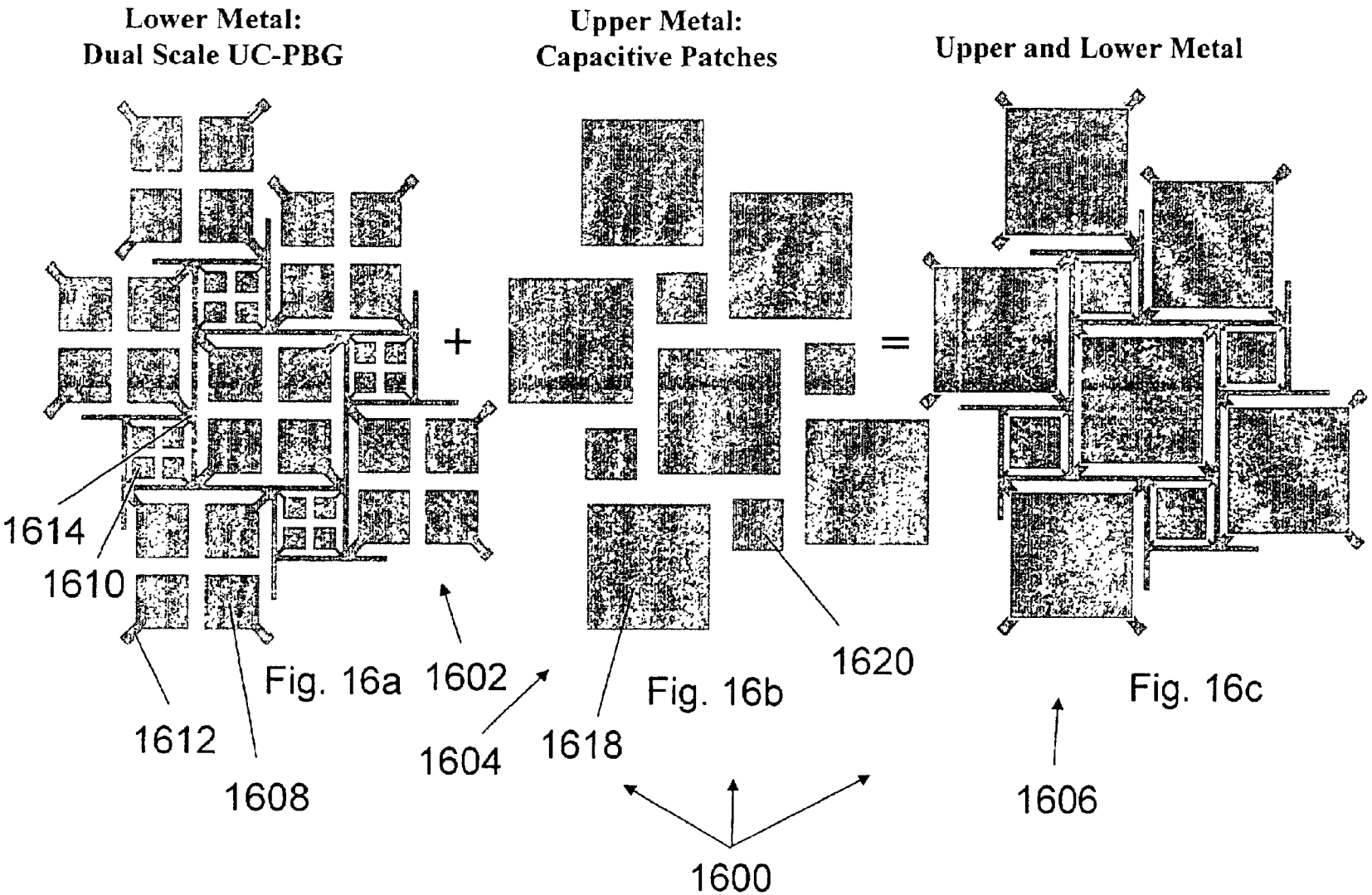
FIGS. 16*a–c* illustrate top views of upper and lower layers of another embodiment of a DCL FSS as well as the combination of the upper and lower layers of the embodiment.

FIG. 16 illustrates a DCL FSS 1600 with a fan blade inductive grid 1602 similar to that shown in FIG. 15. In this fan blade grid 1602, however, the delineated squares of FIG. 15 each contain a plurality of smaller solid capacitive patches 1608, 1610 with areas that depend on the area of the delineated square. As shown, each of the four capacitive patches 1608, 1610 are connected to the conductor that forms the inductive grid 1616 via a straight line segment 1612. The straight line segment 1612 is connected at the corners of the capacitive patches 1608, 1610, runs diagonally to the grid 1616, and is connected to the grid 1616 at T intersections 1614 of the grid 1616 (the corners of the delineated squares). While a single layer FSS structure may be formed using this fan blade grid 1602 alone, an additional upper conductive layer 1604 as shown in FIG. 16*b* may be added to reduce the fundamental resonant frequency of the single layer structure. The upper conductive layer 1604 contains solid patches 1618, 1620 of different sizes. The different sizes and positions of these solid patches 1618, 1620 are aligned with the delineated squares such that the capacitive patches 1608, 1610 of the lower conductive layer 1602 are substantially overlapped without overlapping the grid 1616.

As shown, the solid patches 1618, 1620 are disposed such that they overlap both the areas of the capacitive patches 1608, 1610 of the lower conductive layer 1602 and the gaps between the capacitive patches 1608, 1610 of the lower conductive layer 1602. However, as long as the desired parallel plate capacitance is established, the size and shape of either patch (the squares of the lower or upper layers) is not critical. For example, the solid patches 1618, 1620 may be further increased in number, decreased in size and aligned such that they overlap the capacitive patches 1608, 1610 of the lower conductive layer 1602 but do not overlap the gaps between the capacitive patches 1608, 1610 of the fan blade 1602.

FIGS. 17–23 illustrate yet another set of embodiments of DCL FSS structures that are multi-resonant. To achieve multi-resonant behavior with a smaller period size than is available with a dual scale UC-PBG, the embodiment shown in FIG. 17 may be used whereby, two closely spaced conductive layers are separated by a dielectric layer. As shown in FIG. 14, the simple square capacitive patches of FIG. 3*b* may be transformed into loops. The loop comers form parallel-plate capacitors with the patches on the inductive grid layer while the notches form an inductance between the patches of the upper conductive layer.

Thus, for example one side of the FSS may be an array of Cohn squares, while the other side of the FSS is a crossed dipole FSS in which the ends of the dipoles are connected by chip inductors or very thin lines. The result is a capacitive FSS layer, $C_c$, in parallel with an inductive FSS grid, $L_1$, that has a capacitor, $C_t$, in tank with part of its inductance $L_2$. The relative sizes of the straight and looping sections of the inductive grid (and/or the value of the chip inductors) permit control of the relative sizes of the two inductors. Similarly, the capacitors can be given different relative sizes by controlling the edge-to-edge gap of the Cohn squares, the length of the inductive FSS grid's straight sections, or by adding a third capacitive FSS layer, staggered behind the Cohn squares layer to increase its capacitance without affecting the inductive grid.

Figure 18:
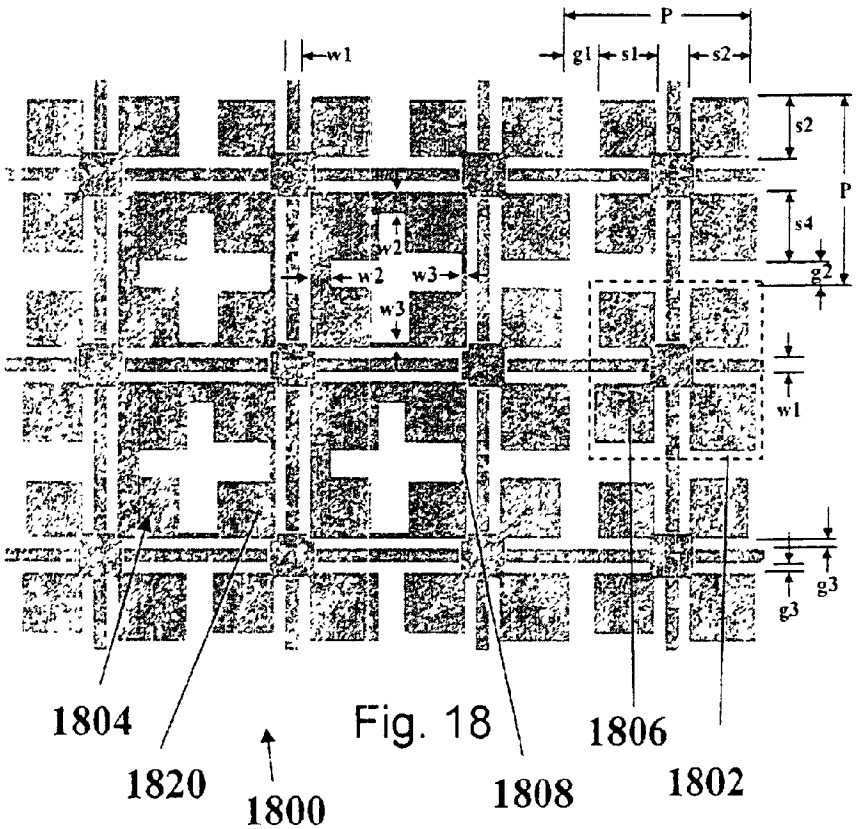
FIG. 18 illustrates a top view of another embodiment of a DCL FSS.
Figure 17:
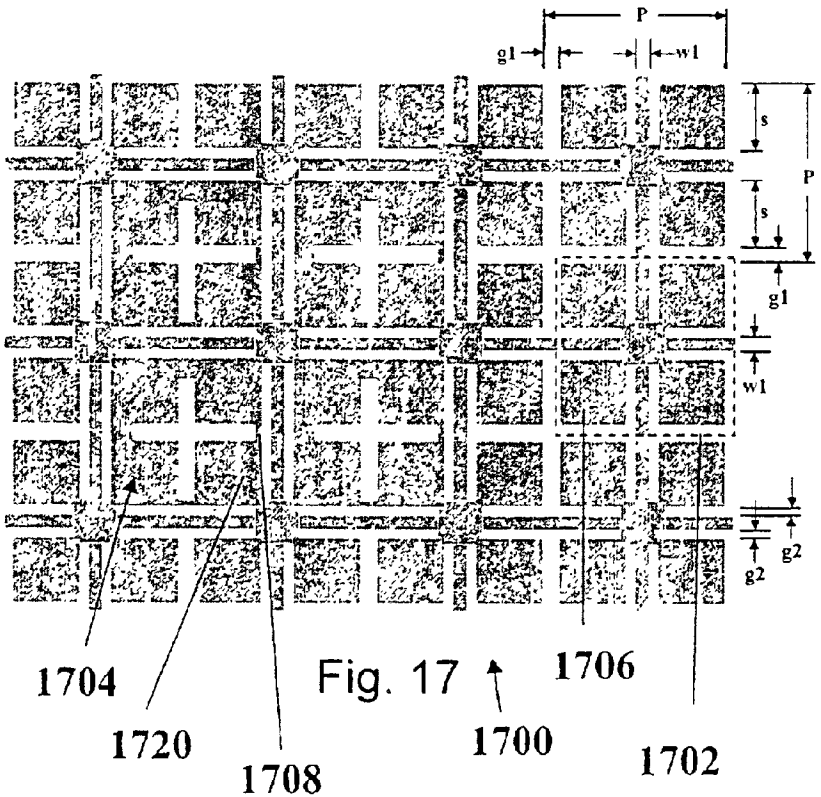
FIG. 17 illustrates a top view of another embodiment of a DCL FSS.

Other relatively simple embodiments are shown in FIGS. 17 and 18. FIGS. 17 and 18 show an FSS 1700, 1800 in which one layer of the FSS 1700, 1800 contains an array of the cloverleaf capacitive patches 1702, 1802 while another layer contains a loop 1704, 1804. As shown, capacitive patches 1704, 1804 of the upper layer have been modified from a simple square to a square with an internal cutout that substantially matches the gaps between the cloverleaf capacitive patches in the underlying layer 1702, 1802. The only differences between the FSS in FIGS. 17 and 18 is that in FIG. 17 the Cohn squares 1706 that form the petals of the capacitive patches in the underlying layer 1702, 1802 as well as the squares 1720 of the overlap layer 1720 have the same area. In FIG. 18, however, the areas of three out of the four petals 1806 of the underlying cloverleaf patches 1802, as well as the corresponding squares 1820 of the overlap loop are unequal (this alters the length and the width of the straight line segments 1708, 1808 connecting the corners of the squares 1720, 1820). The changes in the amount of overlap as well as the connections been the individual squares alters both the capacitance and the inductance of the FSS. Like the previous embodiments, the sections of the patches on the overlying layer that form the parallel plate capacitance with the underlying layer substantially match the size and position of the petals on the underlying cloverleaf.

Figure 20:
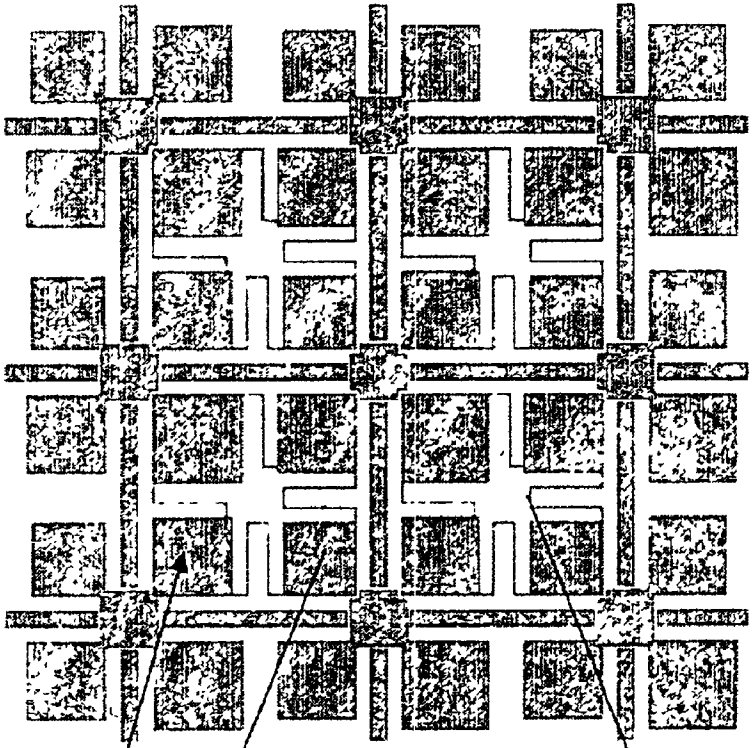
FIG. 20 illustrates a top view of another embodiment of a DCL FSS.
Figure 19:
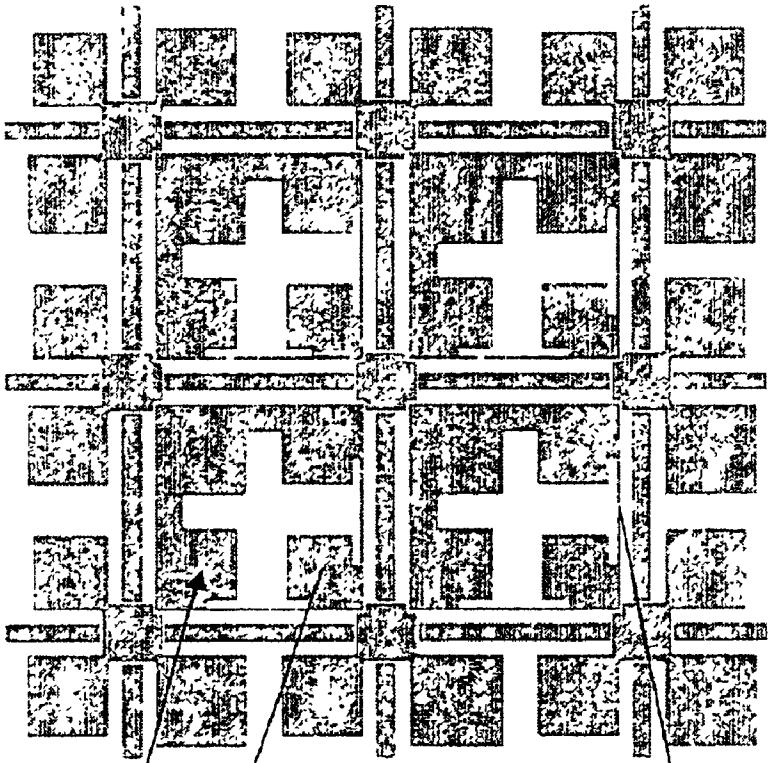
FIG. 19 illustrates a top view of another embodiment of a DCL FSS.

FIGS. 19–21 illustrate other embodiments in which the inductance in series with the upper conductive layer of capacitive patches is increased. The main difference between the FSS 1800 of FIGS. 18 and the FSS 1900, 2000 of FIGS. 19 and 20 is that the squares 1904, 2004 that form the loop 1902, 2002 in the upper layer of capacitive patches are connected by a longer straight line segment 1906 (FIG. 19) or a meanderline 2006 (FIG. 20) that has a plurality of segments to increase the length of the connection between the squares 2004.

Figure 21B:
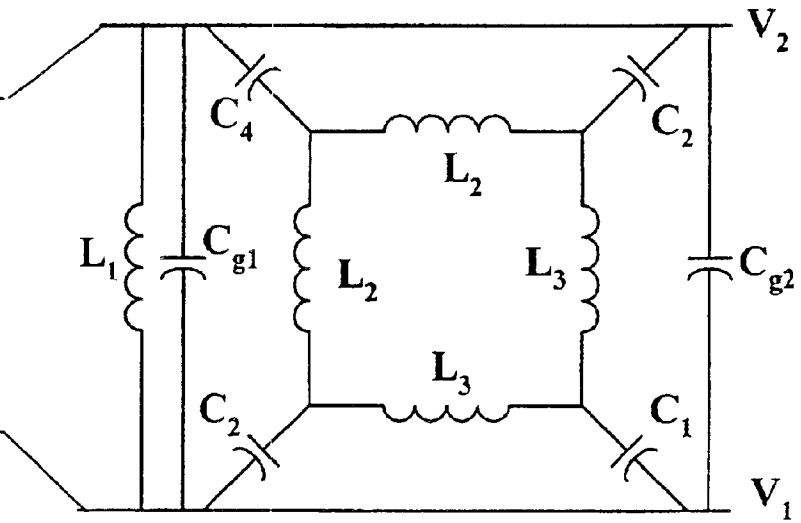
FIGS. 21*a* and *b* illustrate a top view and equivalent circuit diagram of another embodiment of a DCL FSS.
Figure 21A:
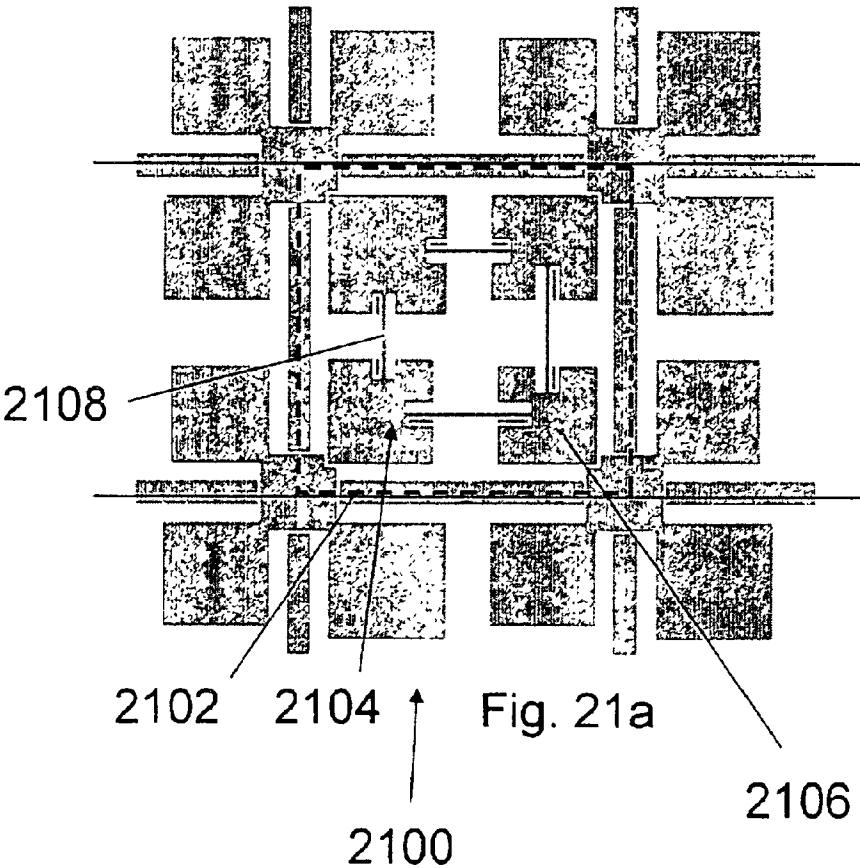
Figures 22A, 22B, 22C, 22D, 22E:
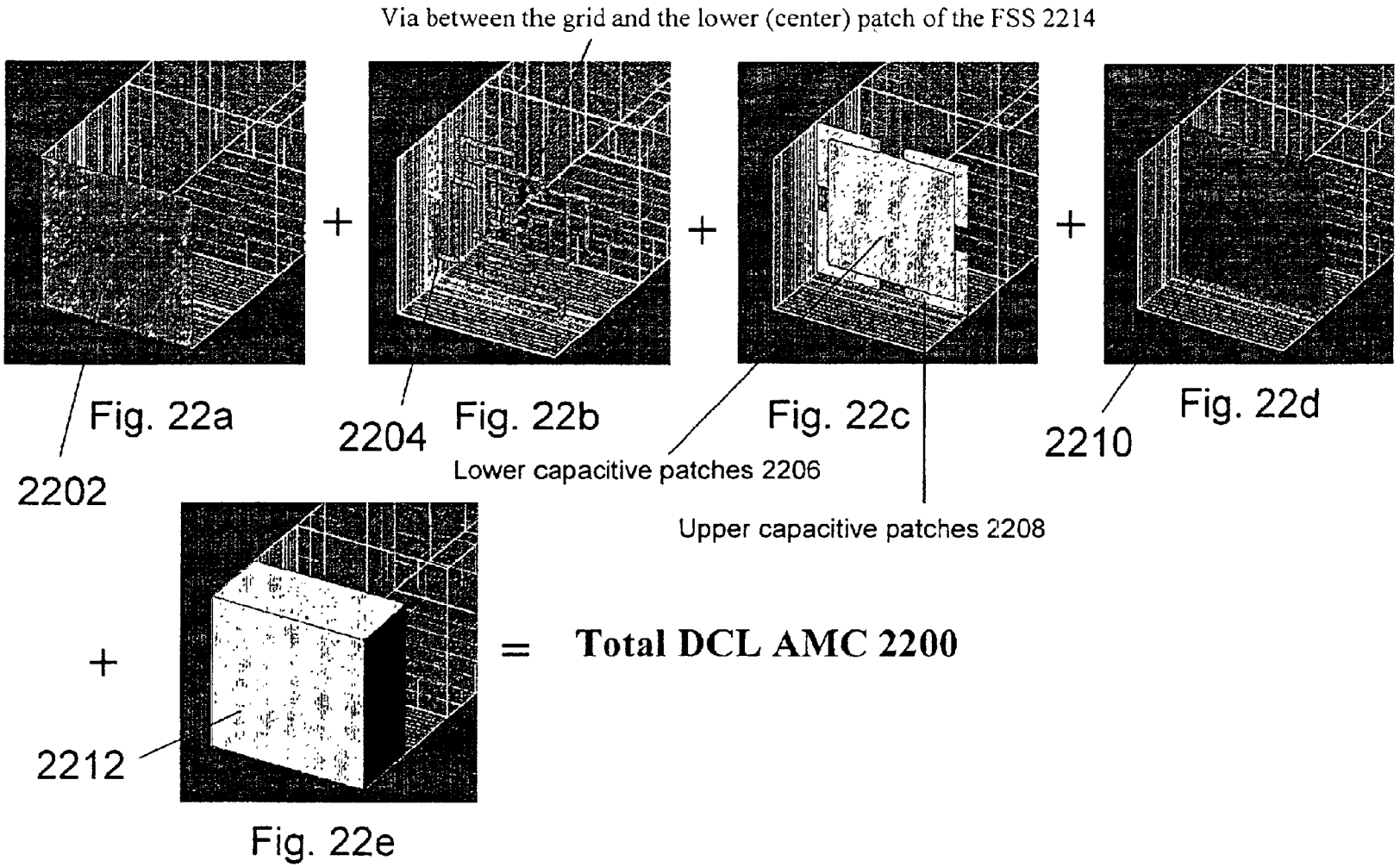
FIGS. 22*a–e* are perspective views of individual components of another embodiment of a DCL FSS, illustrated within a unit cell.

FIG. 21*a* illustrates a multi-resonant DCL FSS 2100 whereby an upper conductive layer has a unit cell 2102 with a loop 2104 that has squares 2108 connected by a straight line segment 2106. Unlike the previous embodiments of FIGS. 19 and 20, for example, the straight line segments 2106 connects the squares 2108 at the center of the sides of the squares 2108, notches are formed in the squares 2108, and the length, but not the width of the straight line segments 2106 of at least some of the straight line segments 2106 are different. FIG. 21*b* shows the approximate equivalent circuit of the entire structure of FIG. 21, including the upper and lower FSS layers as seen by a y-polarized normally-incident electric field. The equivalent impedance of this structure is given by:

$$Z_{eq} = \left[ j\omega L_1 \| \frac{1}{j\omega(C_{g1} + C_{g2})} \right] \| [Z_1 + Z_4 + (j\omega L_2 + Z_2 + Z_5) \| (j\omega L_3 + Z_3 + Z_6)] \text{ where}$$

$$Z_1 = \frac{Z_a Z_c}{Z_a + Z_b + Z_c} \quad Z_2 = \frac{Z_a Z_b}{Z_a + Z_b + Z_c} \quad Z_3 = \frac{Z_b Z_c}{Z_a + Z_b + Z_c}$$

$$Z_4 = \frac{Z_d Z_f}{Z_d + Z_e + Z_f} \quad Z_5 = \frac{Z_d Z_e}{Z_d + Z_e + Z_f} \quad Z_6 = \frac{Z_e Z_f}{Z_d + Z_e + Z_f} \text{ and}$$

$$Z_a = \frac{1}{j\omega C_4} \quad Z_b = j\omega L_2 \quad Z_c = Z_d = \frac{1}{j\omega C_2} \quad Z_e = j\omega L_3 \quad Z_f = \frac{1}{j\omega C_1}$$

It may not be evident from the above formulas, but the effective sheet impedance, $Z_{eq}$, has poles at four frequencies which may be user defined and non-harmonically related. An example of design parameters for these structures is $C_1=C_2=C_4=2$ pF, $Cg_1=Cg_2=1$ pF, $L_1=5$ nH, $L_2=0.5$ nH, $L_3=5$ nH, t=8 mils (t=the thickness of the FSS dielectric layer separating the upper and lower layers). As the above embodiments show, lumped series inductors in the square grid and/or overlay capacitors of secondary layers may be added to dramatically reduce the fundamental resonant frequency of the FSS.

One advantage of using multi-resonant DCL FSS structures is that they can be employed in multi-band AMCs if conductor backed (i.e. a ground plane is separated from the DCL FSS), or used in multi-band patch antennas if they are employed as the patch or ground plane. As noted above, a multi-band DCL AMC is a type of high impedance surface that can be fabricated by employing the above multi-resonant DCL FSS structures and placing these FSS structures parallel and electrically close to a simple metal ground plane (a continuous sheet of conductor). The high impedance surface is the FSS side. Unlike the conventional Sievenpiper AMC, the DCL AMC does not have vertical conductors connecting capacitive patches of the FSS to the ground plane. The absence of such vertical conductors decreases the manufacturing cost of the DCL AMC compared with that of the Sievenpiper AMC. Other conventional DCL AMCs, such as a simple conductor-backed UC PBG, have a period which is about $\lambda/10$ at the fundamental resonant frequency of the FSS, and the period is about $\lambda/7$ at the AMC resonant frequency. The present DCL AMCs have smaller with respect to the wavelength, as needed by many applications.

Any of the low frequency enhanced DCL FSS structures described above may be conductor-backed, with a dielectric substrate or air spacer in between, to realize a low frequency enhanced DCL AMC. The more complex members of this DCL AMC family have multiple poles in the analytic function which defines the FSS transverse permittivity, $\epsilon_t$.

One embodiment of a DCL AMC is shown in FIG. 22*a–e*. It exhibits a TE mode cutoff for surface waves, but not a TM mode cutoff, in the frequency range near the high impedance band (the ±90° bandwidth). This embodiment is essentially the same as the FSS shown in FIGS. 7*a* and 7*b* with the addition of a ground plane. Thus, as shown in the AMC 2200 of FIGS. 22*a–e,* the ground plane 2202 is separated from the lower layer of capacitive patches 2206 by an FR4 dielectric substrate 2212. The inductive grid 2204 is disposed within the dielectric substrate 2212. The center of each unit cell of the inductive grid 2204 is connected with the center of the capacitive patches on the lower layer of capacitive patches 2206 using a 0.25 mm via 2214. The lower layer of capacitive patches 2206 is separated from the upper layer of capacitive patches 2208 by an FSS dielectric 2210 comprised of 2 mils of polyimide.

The period of the upper and lower layers of capacitive patches 2306 and 2308 is the same, 6.25 mm. The capacitive patches 2306 and 2308 are 5.25 mm on each edge of the square. The reflection phase bandwidth of this DCL AMC 2200 is measured to be nominally from 1900 MHz to 2060 MHz with resonance near 1990 MHz, a TE mode cutoff near 2.0 GHz, and no TM mode cutoff near 2.0 GHz (i.e. no TM mode cutoff near its high impedance bandwidth). Of course, the values are merely exemplary and may be altered as desired, depending on many factors such as the shape and area of the patches and inductive grid or thicknesses of the FSS dielectric and dielectric substrate for example.

In addition to AMCs, however, a multi-band planar inverted F antenna (PIFA) may be demonstrated, such as a dual-band PIFA. PIFA structures have been discussed at length, for example in provisional application No. 60/354,003 filed Jan. 23, 2002 and entitled, "DC INDUCTIVE SHORTED PATCH ANTENNA" herein incorporated by reference. A PIFA exhibits one resonant frequency when the lid of the PIFA is simple conductive layer (metal patch). However, if a DCL FSS is substituted for the lid, then a multi-band resonator may be realized. The PIFA cross-section may be viewed as a transmission line supporting a fast wave and a slow wave. The open and short circuit boundary conditions on the ends of the PIFA force both waves to be standing waves. The PIFA is approximately one-quarter guide wavelength long at resonance, which occurs when the electrical length satisfies $\theta=\beta(L+\Delta L)=90°$ where $\beta$ is the phase constant and L the physical length of the transmission line and $\Delta L$ the additional length which accounts for the radiation susceptance $B_{rad}$. The equivalent circuit diagram of the transmission line structure is shown in FIG. 23*a* while a phase constant vs. frequency plot is shown in FIG. 23*b*.

The end result is that a low and high resonant frequency is observed due to the slow and fast wave nature of the modes propagating on the DCL FSS transmission line. Because the slow wave factor is significant, typically a factor of two, then the size of the PIFA can be reduced by a factor of two relative to the simple case of a metal lid. This means that a PIFA antenna can be made which is only $\lambda/10$ (where $\lambda$ is again the free space wavelength) in its longest dimension. Furthermore, no bulk dielectric loading is needed, so this approach is also very lightweight.

Figure 23B:
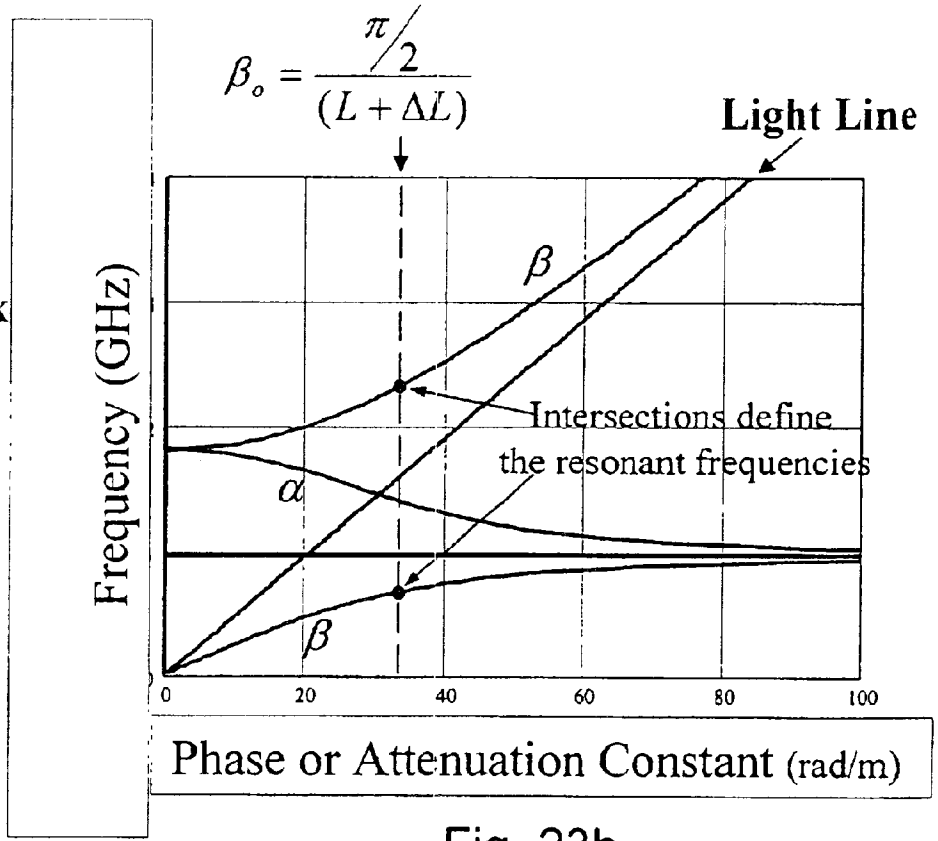
FIGS. 23*a* and *b* illustrate an equivalent circuit diagram and dispersion diagram of phase constant vs. frequency of another embodiment.
Figure 23A:
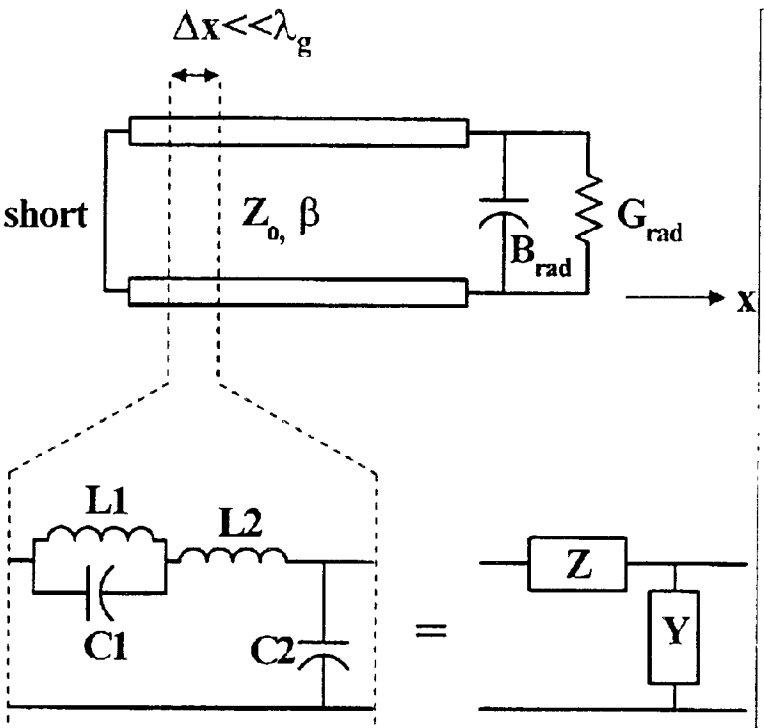
Figures 24A, 24B, 24C, 24D:
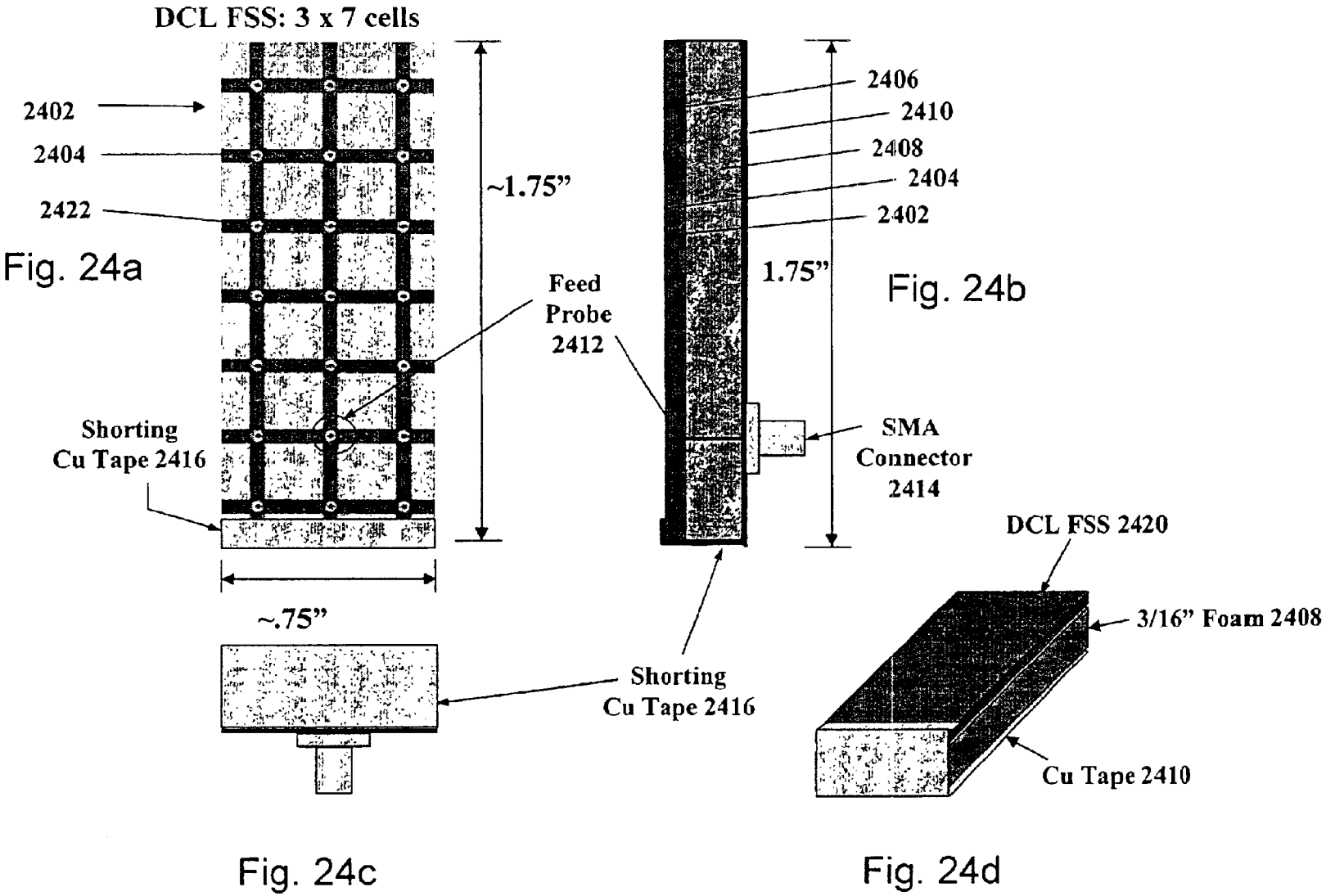
FIGS. 24*a–d* illustrate top view, cross-sectional, end, and perspective views of another embodiment.

The phase constant $\beta$ can be calculated from an equivalent circuit model which models the per unit length properties of the transmission line, as shown in FIG. 23*a*. In this figure, $L_1$ and $C_1$ model the magnetic and electric field energy stored in the DCL FSS while $L_2$ and $C_2$ model the energy stored in the external magnetic and electric fields which surround the microstripline. The solution of the phase constant is given $$\beta = \omega\sqrt{\left(L_2 + \frac{L_1}{1-\omega^2 L_1 C_1}\right)C_2} = \omega\sqrt{(L_1+L_2)C_2\left[\frac{1-\omega^2\frac{L_1 L_2}{L_1+L_2}C_1}{1-\omega^2 L_1 C_1}\right]}$$

A plot of frequency as a function of phase constant for the equation above yields the dispersion curve shown in FIG. 23*b* for values (L=44 mm, W=18.75 mm, $C_1=4.5\times10^{-14}$ pF/m, $L_1=5.87\times10^{-7}$ H/m, $C_2=46$ pF/m, $L_2=2.42\times10^{-7}$ H/m). The slow waves can propagate below $\omega_p=1/\sqrt{L_1C_1}$ while the fast waves can propagate above $$\omega_z = 1\Big/\sqrt{\frac{L_1 L_2}{L_1+L_2}C_1}\,.$$

As shown in FIG. 23*b*, a stopband exists between the two frequencies, $\omega_p$ and $\omega_z$. The PIFA resonant frequencies are given by the intersection of the phase constant curves with the $\beta_0$ line.

A variety of DCL FSS PIFAs may be fabricated. Some of these PIFAs may use the design shown in FIGS. 7*a* and 7*b*. One such embodiment is illustrated in FIGS. 24*a–d*, which show the top, cross-sectional, end, and perspective views, respectively of a PIFA 2400. The capacitive patches 2402 (here solid squares) are shown in the top view of the PIFA 2400 in FIG. 24*a*. The capacitive patches 2402 are fabricated on a thin FSS dielectric 2404 (printed circuit board) and an inductive grid 2406 is formed on the opposing surface of the printed circuit board 2404. The combination of the capacitive patches 2402, FSS dielectric 2404, and an inductive grid 2406 form the DCL FSS 2420. A thick dielectric substrate 2408 separates the inductive grid 2406 and the ground plane 2410. The dielectric substrate 2408 may be formed from a low permittivity material such as foam. The DCL FSS 2420 may be attached to the foam substrate 2408 either permanently or temporarily, for instance by using repositionable spray adhesive.

A conductive material 2416, such as the copper foil used here, is used to ground the end of the array of capacitive patches 2402 to the ground plane 2410. The metal 2416 placed on the end of the array 2402 is called the PIFA short or shorting wall. It is not necessary that the ground plane 2410 be formed from the same material as the PIFA short 2416 as shown in the figures. Similarly, although the ground plane 2410 is formed from a flexible material as shown, such flexibility may not be essential—the ground plane may be formed from a thicker, more rigid layer of conductive material or may be buttressed by a separate rigid layer. The detriment to this is that such a layer will add thickness and weight to the overall PIFA structure. The DCL FSS 2420 is fabricated such that the capacitive patches 2402 terminate in a set of half patches 2418, i.e. the end of the DCL FSS 2420 aligns with the center of one of the patches 2418. The PIFA short 2416 is attached to the end of the layer of capacitive patches 2402 such that it contacts the half patches 2418 and does not contact any vertical conductors (vias) 2412. Altering the fabrication of the DCL FSS 2420 such that the edges of the capacitive patches 2402 does not align with the center of one of the patches will change the electrical characteristics of the PIFA 2400.

A feed probe 2412 is a via that feeds signals to the DCL FSS 2420 through the dielectric substrate 2408. The feed probe 2412 is connected with one of a plurality of plated through holes 2422 disposed between the capacitive patches 2402. Although only one via is depicted and may be necessary, a forest of vias may exist depending on the fabrication method (only one of which is the feed probe). The feed probe 2412 is feeding signals through a connector 2414, here a SMA connector, disposed on the ground plane 2410. The outer surface of the connector 2414 may be connected to, and thus share a common ground with, the ground plane 2410. The center conductor (not shown) of the SMA connector 2414 is extended using 24 AWG wire to form the feed probe 2412.

Figures 25A, 25B, 25C:
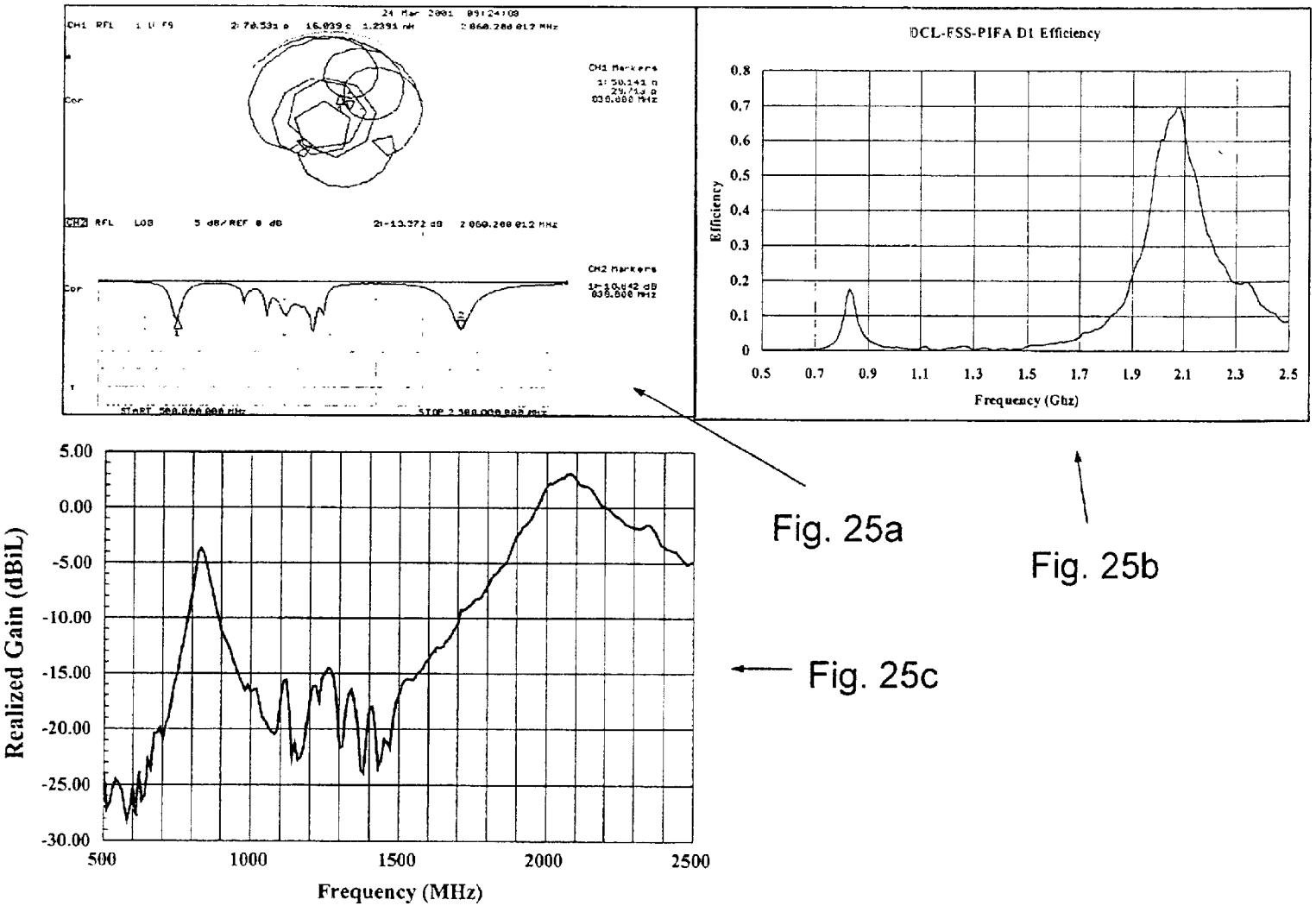
FIGS. 25*a–c* are plots of characteristics of the embodiment of FIGS. 24*a–d;*
Figure 26:
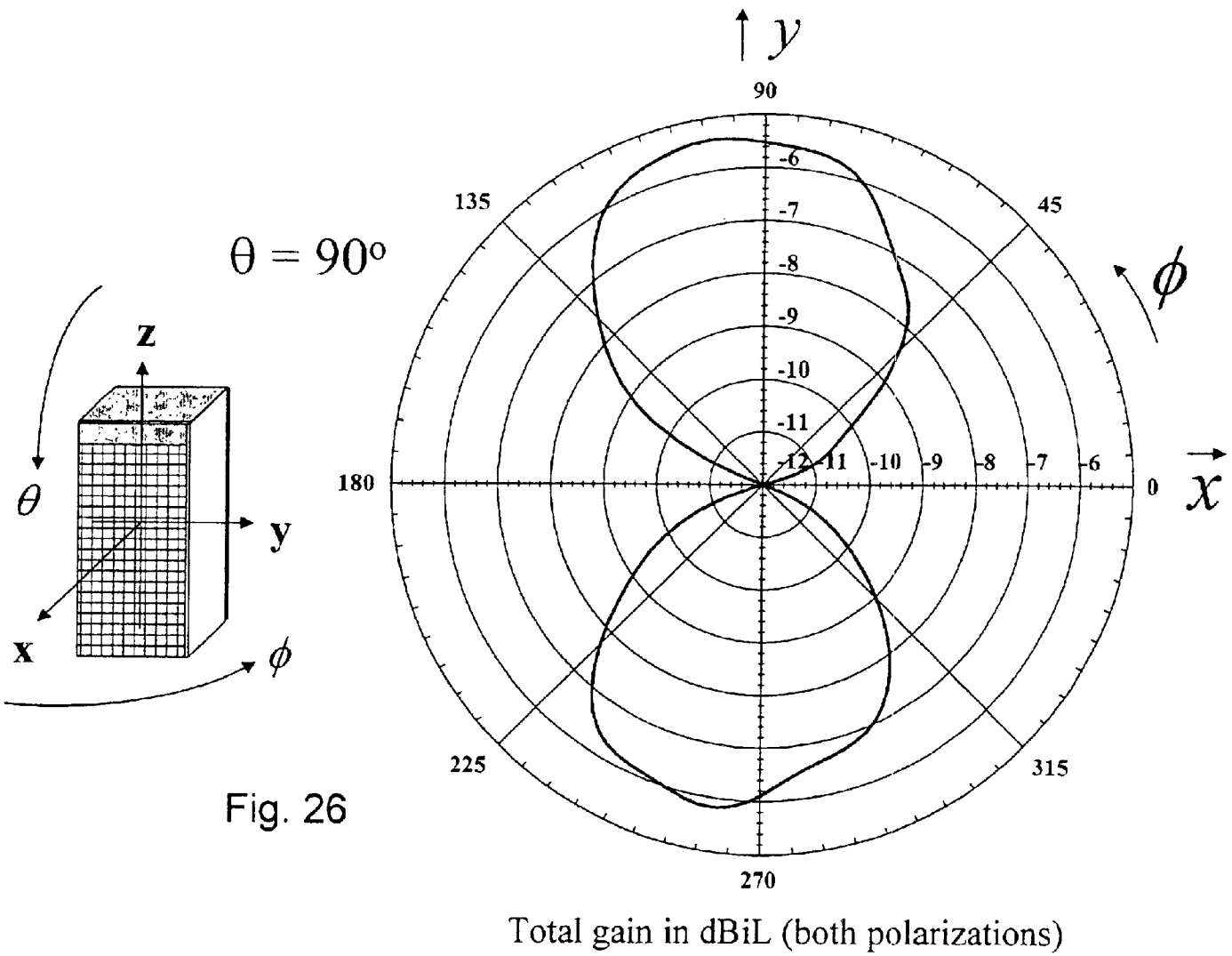
FIGS. 26–29 are gain plots of the embodiment of FIGS. 24*a–d;*.
Figure 27:
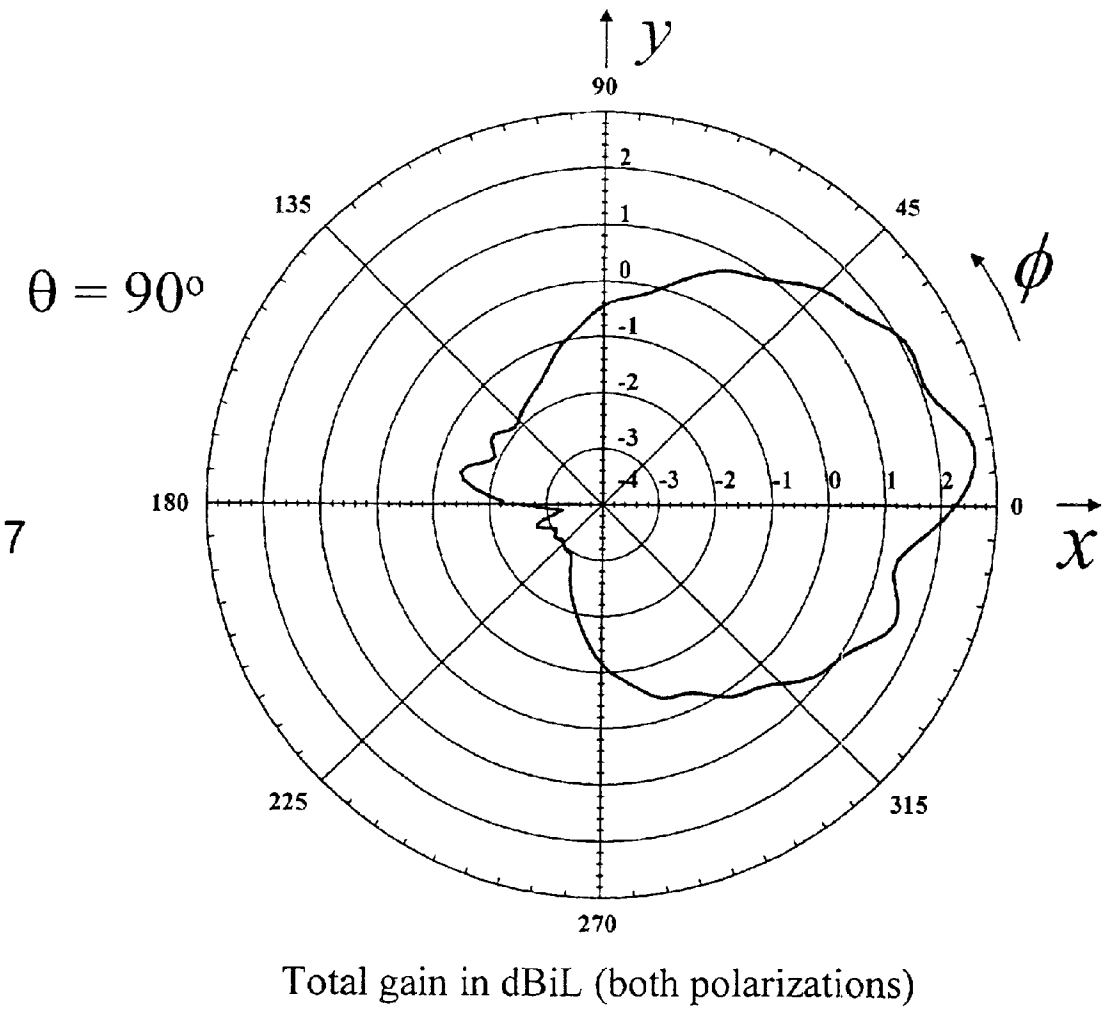
Figure 28:
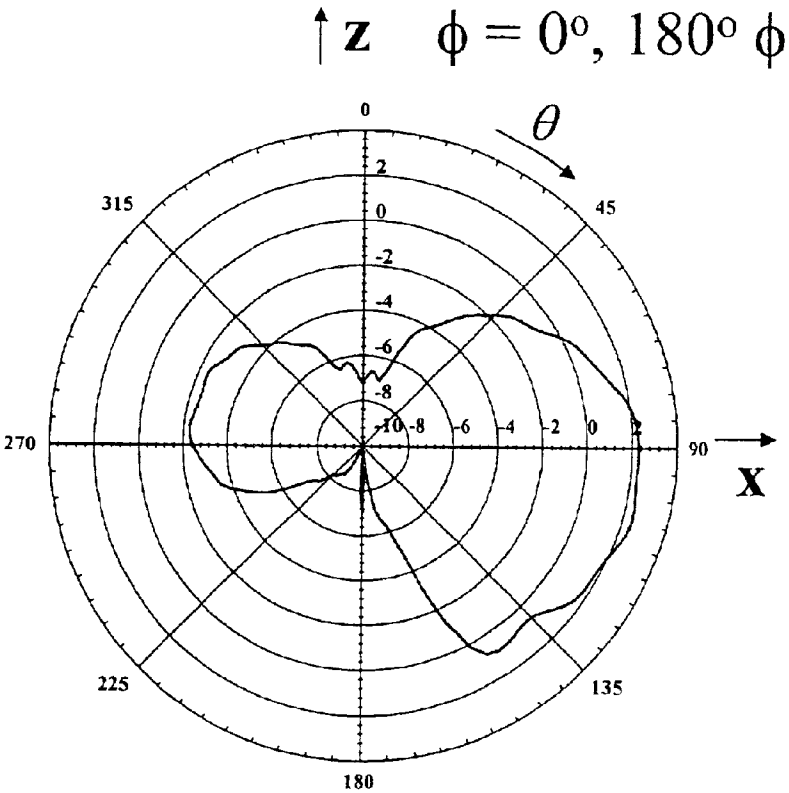
Figure 29:
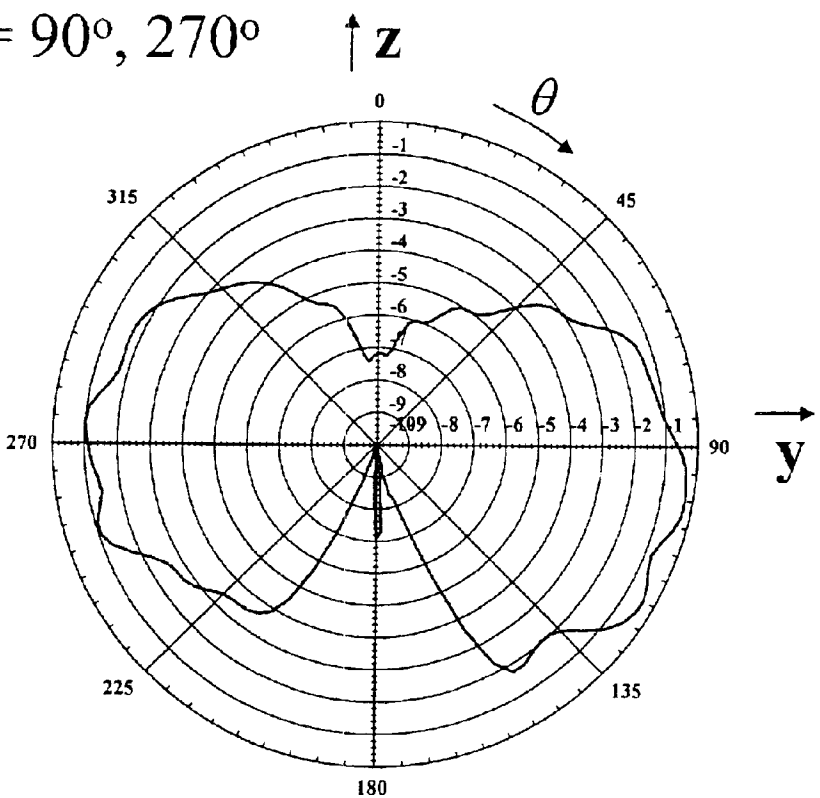
Figures 30A, 30B, 30C, 30D:
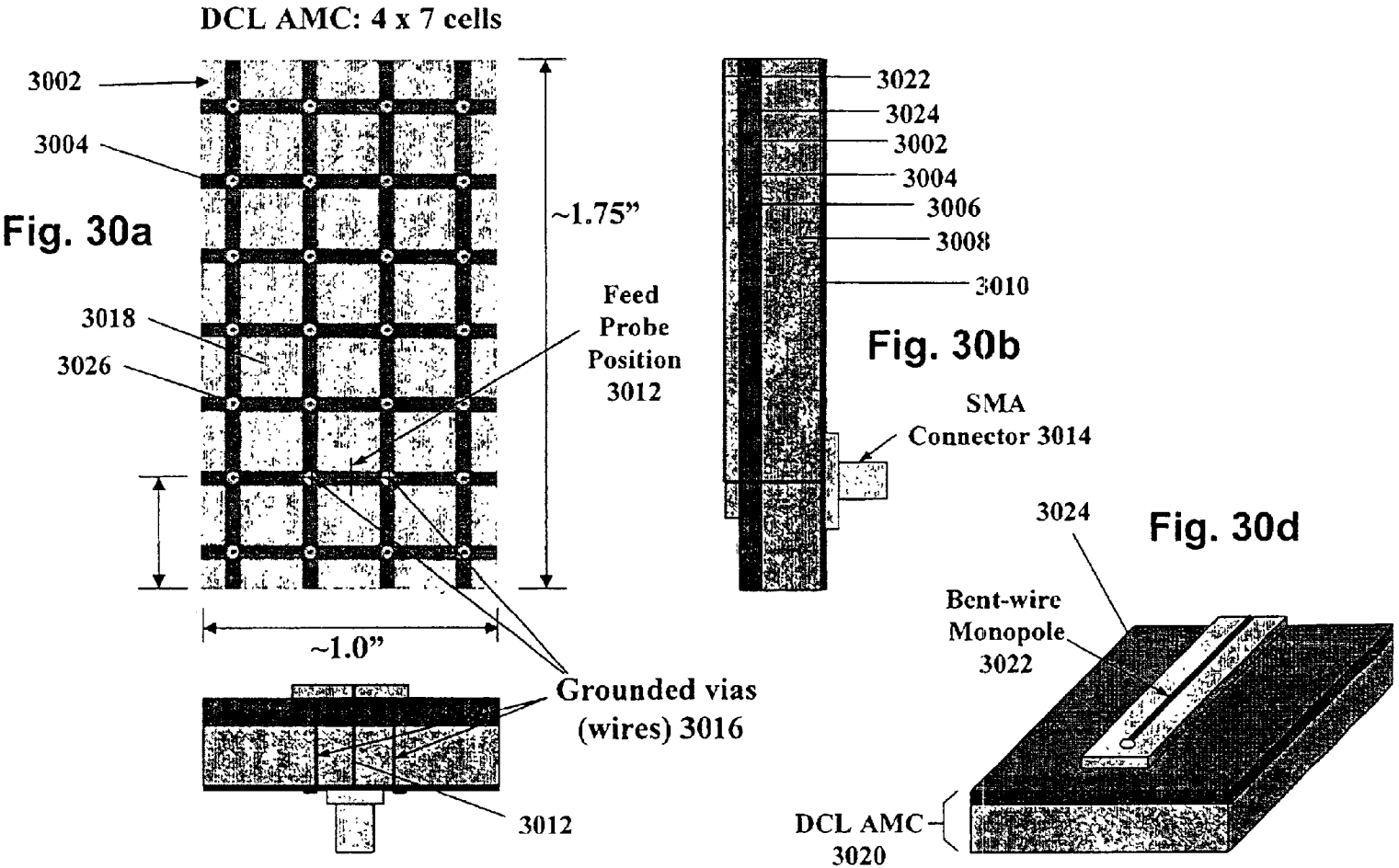
FIGS. 30*a–d* illustrate top view, cross-sectional, end, and perspective views of another embodiment.

FIGS. 25*a–c* are plots of experimental results for the PIFA of FIGS. 24*a–d*. FIG. 25*a* shows the return loss of the PIFA 2400 as a function of frequency. FIGS. 25*b* and *c* show the efficiency and gain of the PIFA 2400 as a function of frequency. FIGS. 26–29 show the azimuth gain pattern of the PIFA 2400 at 840 MHz and 2080 MHz for $\theta=90°$, $\theta=0°$, 180° and $\phi=90°$, 270°, respectively.

It is also possible to create embodiments of DCL FSS structures that exhibit not one, but two frequencies where the effective sheet impedance becomes infinite, or exhibits a parallel resonance. Such embodiments can be realized by cascading unit cells of two different simple DCL FSS designs, such as that shown in the fan blade structures of FIGS. 15 and 16. A triple-band PIFA, for example, which resonates at three different frequencies, may be fabricated from these DCL FSS structures when the DCL FSS is used as the lid of the PIFA.

PIFAs are not the only radiating structures that can use DCL FSS structures. In addition, DCL AMCs that use DCL FSS structures can be used to make an electrically thin antenna. An example of such an antenna is an antenna element, for example a bent-wire monopole, that is disposed electrically and physically close to the DCL AMC. One example of an electrically thin antenna is shown in FIGS. 30*a–d* and is similar to the PIFA 2400 of FIGS. 24*a–d*. FIGS. 30*a–d* show the top, cross-sectional, end, and perspective views, respectively of the antenna element 3000.

Similar to the PIFA 2400, the capacitive patches 3002 of the antenna 3000 are fabricated on a thin FSS dielectric 3004 and an inductive grid 3006 is formed on the opposing surface of the FSS dielectric 3004. A thick FR4 dielectric substrate 3008 separates the inductive grid 3006 and the ground plane 3010. The combination of the capacitive patches 3002, FSS dielectric 3004, an inductive grid 3006, and ground plane 3010 forms a DCL AMC 3020. The DCL AMC 3020 is fabricated such that the capacitive patches 3002 terminate in a set of half patches 3018, i.e. the end of the DCL AMC 3020 aligns with the center of one of the patches 3018.

Unlike the PIFA, the antenna 3000 of this embodiment does not require a short on the end of the capacitive patches.

Rather, the antenna 3000 can use an RF short formed by a pair of grounded vias 3016 that connects the ground plane 3010 to the inductive grid 3006. Such a connection is important to achieve a reasonable impedance match. The RF short is fabricated by drilling two additional small holes through the DCL AMC 3020 for the grounded vias 3016 and soldering the grounded vias 3016 to plated through holes 3026 in the inductive grid, the ground plane 3010 and between the capacitive patches 3002. The grounded vias 3016 that form the RF short are disposed at comers of the capacitive patches 3002, horizontally adjacent to the feed probe 3012 and one half of a period from the feed probe 3012. The feed probe 3012 is an additional hole drilled between the grounded vias 3016. A bent-wire monopole 3022 or other suitable antenna structure is disposed on an antenna dielectric 3024. The bent-wire monopole 3022 and antenna dielectric 3024 are disposed close to the capacitive patches 3002 for efficient radiation of a signal fed to the bent-wire monopole 3022. In one example, the bent-wire monopole 3022 is 1.375" long and 0.050" wide and is disposed on a 0.031" FR4 dielectric.

The bent-wire monopole 3022 is excited through a feed probe 3012 that extends through the dielectric substrate 3008 and contacts only the center conductor of the coaxial feedline. The feed probe 3012 excites the bent-wire monopole 3022 from a SMA connector 3014 disposed on the ground plane 3010. The outer surface of the connector 3014 may be connected to the ground plane 3010. The center conductor (not shown) of the SMA connector 3014 is extended using 24 AWG wire to form the feed probe 3012.

This antenna 3000 is characterized by a relatively small size (~0.19λ×0.33λ×0.023λ) with a very good front to back ratio of about 8 dB. The input is extremely well matched to 50 ohms without any external matching circuit. The −6 dB return loss bandwidth is about 9%. Although this antenna uses a multi-layer low frequency enhanced DCL FSS and AMC, a simpler one-metal-layer FSS such as the UC-PBG may be used, with the caveat that the resonant frequency is expected to be higher than that of the multi-layer structure. Similarly, like the PIFA above, any of the DCL FSS structures described herein can be used, for example, embodiments containing the additional layer of capacitive patches.

The number and placement of the grounding vias may be altered while maintaining acceptable response. For example, in another embodiment of an antenna which is not shown, rather than the grounding vias being adjacent to the feed to form the shorting wall, four grounding vias may be formed through the AMC. While the feed is again disposed between centers of the capacitive patches and the vias that form the shorting wall are again disposed at corners of the capacitive patches one half of a period from the feed in the horizontal direction, the vias are now offset by one period vertically towards the edge of the layer that contains the half capacitive patches.

In another unillustrated embodiment, a PIFA similar to that shown in FIGS. 24*a–d* is used. Here the vias that form the RF short are replaced by the shorting wall of the PIFA, as in FIG. 24*c*. Any plated through holes fabricated with the PCB may remain uncontacted however.

The above three configurations of the DCL AMC antennas were fabricated and designed to resonated at about 2.0 GHz. Each configuration exhibited a return loss null at or slightly above the AMC resonant frequency. The antenna sizes were all 1.0"×1.75"×0.125" (~0.191λ×0.331λ×0.0231λ). The antenna pattern had a main beam at broadside, normal to the AMC surface. Of the three configurations, the best impedance match was given by the AMC antenna that used a conductive shorting wall at the end of the AMC structure. . The −10 dB return loss bandwidth was 115 MHz or 5.2%, the −6 dB return loss bandwidth was about 200 MHz or 9.1%. The PIFA antenna also had a front to back ratio of ~8 dB, peak and average gains of ±1.7 dBil and −3 dBil, and a realized antenna efficiency peaks slightly above 50%.

Disclosed herein are low frequency DCL FSS and related structures having a fundamental pole frequency $f_p$, in the analytic function modeling the equivalent sheet impedance, may be designed to be much less than one tenth of c/P where c is the speed of light and P is the FSS period. Equivalently, the period of the FSS is less than λ/10 of the free space wavelength at the fundamental pole frequency. Some DCL FSS embodiments may exhibit multiple engineered pole frequencies in the equivalent sheet impedance of the FSS.

Different embodiments of the DCL FSS include an isolated grid DCL FSS, which contains an inductive grid that is coplanar with capacitive patches but DC isolated from the patches. The inductive grid may be used to distribute prime power or to distribute control signals to integrated electronics. The DCL FSS also includes a dual scale, multi-resonant UC-PBG FSS that contains a single metal layer having two characteristic length scales involving one inductive grid and two sizes of conductive patches. Each patch is connected at a one of its corners to a node of the conductive grid. Additional layers of conductive patches can be added as overlay capacitors to reduce the resonant frequencies without increasing the period.

A low frequency DCL AMC, which is a low frequency high-impedance surface, contains the above low frequency enhanced DCL FSS separated from a ground plane by a fixed distance. The DCL AMC may have multiple bands. Such a multi-band DCL AMC includes a DCL FSS that contains at least one Lorentz pole and is separated from a ground plane by a fixed distance.

One embodiment of a DCL AMC antenna contains a DCL AMC and a printed strip or wire located parallel to and above the DCL AMC surface. The printed strip is fed via a vertical probe from a coaxial aperture in the ground plane. The ground plane may be extended up along one edge of the DCL AMC to make conductive contact with some or all of the metal patches or grid. Such a DCL AMC antenna may be useful in many mobile wireless applications, especially wherever it is desirable to have a relatively thin antenna, wherever it is desirable to have a front-to-back ratio of 8 dB or greater (especially important for body-worn applications), and wherever it is desirable to minimize the number of plated through holes in an AMC antenna design.

The DCL FSS PIFA is a multi-band printed antenna comprised of a periodic transmission line shorted at one end. The DCL FSS PIFA has a DCL FSS located above a ground plane with a short circuit at one end and essentially an open circuit at the other end. A feed probe is located between the two ends. The multi-band printed antenna may be modeled by a periodic transmission line in which the periodic unit cell of the transmission line has a particular equivalent circuit.

The DCL FSS PIFA may be useful in many mobile wireless applications, especially where it is desirable to resonate at two or more non-harmonically related frequencies, where it is desirable that the resonant frequencies are insensitive to changing environmental factors such as proximity to a human body and where the volume for antenna integration is extremely limited, approximately λ/10 at most for the largest dimension, where λ is the free-space wavelength at the lowest resonant frequency.

While particular embodiments of the present invention have been shown and described, modifications may be made by one skilled in the art without altering the invention. It is therefore intended in the appended claims to cover such changes and modifications which follow in the true spirit and scope of the invention.

We claim:

1. A frequency selective surface comprising a first conductive layer having a periodic structure of capacitive patches with a first period, the frequency selective surface modeled by an equivalent circuit having second Foster canonical form with a fundamental resonant frequency lower that of a second frequency selective surface consisting of a square lattice of Jerusalem crossed slots with a second period equal to the first period.

2. The frequency selective surface of claim 1, wherein the first period is at most 1/10 of a free space wavelength at the fundamental resonance frequency.

3. The frequency selective surface of claim 1, wherein the conductive layer comprises a printed meanderline inductor.

4. The frequency selective surface of claim 3, wherein the meanderline inductor comprises spiral inductors overlapped by a second conductive layer of capacitive patches separated from the spiral inductors.

5. The frequency selective surface of claim 3, wherein the conductive layer further comprises a printed interdigital capacitor.

6. The frequency selective surface of claim 1, wherein the conductive layer comprises a structure having a plurality of length scales within one unit cell.

7. The frequency selective surface of claim 6, wherein the conductive layer comprises a fan blade structure with an inductive grid that delineates sections of a first and second area.

8. The frequency selective surface of claim 7, wherein the sections of the first and second area each contain a plurality of smaller capacitive patches connected with the grid and having areas that depend on the area of the section.

9. The frequency selective surface of claim 8, wherein the smaller capacitive patches are overlapped by a second conductive layer of capacitive patches separated from the first conductive layer of capacitive patches.

10. The frequency selective surface of claim 1, wherein adjacent capacitive patches are connected by an inductor having an inductance greater than the inductance of a straight line segment connecting the adjacent capacitive patches.

11. The frequency selective surface of claim 10, wherein the inductor comprises a discrete inductor.

12. The frequency selective surface of claim 10, wherein the inductor comprises a meanderline having a length substantially longer than a length of the straight line segment connecting the adjacent capacitive patches.

13. The frequency selective surface of claim 12, wherein the meanderline is coplanar with the first conductive layer of capacitive patches.

14. The frequency selective surface of claim 12, wherein the meanderline is out of plane with the first conductive layer of capacitive patches.

15. The frequency selective surface of claim 10, further comprising a second conductive layer of capacitive patches isolated from each other and the capacitive patches of the first conductive layer, the capacitive patches of the second conductive layer separated from and overlapping a plurality of capacitive patches of the first conductive layer.

16. The frequency selective surface of claim 1, further comprising a second conductive layer of capacitive patches isolated from each other and the capacitive patches of the first conductive layer, the capacitive patches of the second conductive layer separated from and overlapping a plurality of capacitive patches of the first conductive layer.

17. The frequency selective surface of claim 1, wherein the capacitive patches comprise one of a single solid rectangle, a cloverleaf, and a loop.

18. The frequency selective surface of claim 17, further comprising a second conductive layer of capacitive patches isolated from each other and the capacitive patches of the first conductive layer, the capacitive patches of the second conductive layer separated from and overlapping a plurality of capacitive patches of the first conductive layer.

19. The frequency selective surface of claim 1, wherein adjacent capacitive patches are connected through a straight line segment.

20. The frequency selective surface of claim 19, further comprising a second conductive layer of capacitive patches isolated from each other and the capacitive patches of the first conductive layer, the capacitive patches of the second conductive layer separated from and overlapping a plurality of capacitive patches of the first conductive layer.

21. The frequency selective surface of claim 1, the first conductive layer further comprising an inductive grid that surrounds the capacitive patches, wherein the capacitive patches are isolated from each other and the inductive grid.

22. The frequency selective surface of claim 21, further comprising a second conductive layer of capacitive patches isolated from each other and the capacitive patches and inductive grid of the first conductive layer, the capacitive patches of the second conductive layer separated from and overlapping a plurality of capacitive patches of the first conductive layer.

23. A single band artificial magnetic conductor comprising the frequency selective surface of claim 1 and a ground plane separated from the frequency selective surface.

24. An antenna comprising an antenna element on the artificial magnetic conductor of claim 23.

25. The antenna of claim 24, further comprising a vertical probe from a coaxial aperture in the ground plane, the vertical probe feeding the antenna element, the ground plane extended up along one edge of the artificial magnetic conductor so as to make conductive contact with at least some of the capacitive patches of the first conductive layer.

26. A planar integrated F antenna (PIFA) comprising the artificial magnetic conductor of claim 23, wherein the frequency selective surface is employed as a lid of the PIFA, the PIFA is connected to the ground plane at one end, has essentially an open circuit at an opposing end, and has a feed probe located between the one end and the opposing end.

27. A multi-resonant artificial magnetic conductor comprising the frequency selective surface of claim 1 and a ground plane separated from the frequency selective surface, the frequency selective surface containing at least one Lorentz pole.

28. An antenna comprising an antenna element on the artificial magnetic conductor of claim 27.

29. The antenna of claim 28, further comprising a vertical probe from a coaxial aperture in the ground plane, the vertical probe feeding the antenna element, the ground plane extended up along one edge of the artificial magnetic conductor so as to make conductive contact with at least some of the capacitive patches of the first conductive layer.

30. A planar integrated F antenna (PIFA) comprising the artificial magnetic conductor of claim 27, wherein the frequency selective surface is employed as a lid of the PIFA, the PIFA is connected to the ground plane at one end, has essentially an open circuit at an opposing end, and has a feed probe located between the one end and the opposing end.

31. A planar integrated F antenna (PIFA) comprising the frequency selective surface of claim 1 employed as a lid of the PIFA and a ground plane separated from the frequency selective surface.

32. A frequency selective surface comprising a first conductive layer having a periodic structure of capacitive patches and a second layer separated from the first conductive layer, the second layer coupled to the first conductive layer such that one of an effective inductance and capacitance of an effective inductive-capacitive circuit that models electromagnetic characteristics of the frequency selective surface is substantially affected by presence of the second layer.

33. The frequency selective surface of claim 32, wherein a period of the frequency selective surface is at most 1/10 of a free space wavelength at the resonance frequency of the frequency selective surface.

34. The frequency selective surface of claim 32, wherein the first conductive layer comprises a printed meanderline inductor.

35. The frequency selective surface of claim 32, wherein the meanderline inductor is a spiral inductor and the second layer comprises capacitive patches each of which overlaps a plurality of the spiral inductors.

36. The frequency selective surface of claim 32, wherein the first conductive layer further comprises a printed indigital capacitor.

37. The frequency selective surface of claim 32, wherein the first conductive layer comprises a structure having a plurality of length scales in one unit cell.

38. The frequency selective surface of claim 37, wherein the first conductive layer comprises a fan blade structure with an inductive grid that delineates sections of a first and second area.

39. The frequency selective surface of claim 38, wherein the sections of the first and second area each contain a plurality of smaller capacitive patches connected with the inductive grid and having areas that depend on the area of the section.

40. The frequency selective surface of claim 39, wherein the second layer comprises capacitive patches that overlap the smaller capacitive patches of the first conductive layer.

41. The frequency selective surface of claim 32, wherein adjacent capacitive patches are connected by an inductor having an inductance greater than the inductance of a straight line segment connecting the adjacent capacitive patches.

42. The frequency selective surface of claim 41, wherein the inductor comprises a discrete inductor.

43. The frequency selective surface of claim 32, wherein the inductor comprises a meanderline having a length substantially longer than a length of the straight line segment connecting the adjacent capacitive patches.

44. The frequency selective surface of claim 43, wherein the meanderline is coplanar with the first conductive layer of capacitive patches.

45. The frequency selective surface of claim 43, wherein the meanderline is out of plane with the first conductive layer of capacitive patches and the second layer.

46. The frequency selective surface of claim 43, wherein the second layer comprises the meanderline.

47. The frequency selective surface of claim 45, wherein the second layer comprises capacitive patches isolated from each other and the capacitive patches of the first conductive layer, the capacitive patches of the second layer separated from and overlapping a plurality of capacitive patches of the first layer.

48. The frequency selective surface of claim 32, wherein the second layer comprises capacitive patches isolated from each other and the capacitive patches of the first conductive layer, the capacitive patches of the second layer separated from and overlapping a plurality of capacitive patches of the first layer.

49. The frequency selective surface of claim 32, wherein the capacitive patches comprise one of a single solid rectangle, a cloverleaf, and a loop.

50. The frequency selective surface of claim 49, wherein the second layer comprises capacitive patches isolated from each other and the capacitive patches of the first conductive layer, the capacitive patches of the second layer separated from and overlapping a plurality of capacitive patches of the first layer.

51. The frequency selective surface of claim 32, wherein adjacent capacitive patches are connected through a straight line segment.

52. The frequency selective surface of claim 51, wherein the second layer comprises capacitive patches isolated from each other and the capacitive patches of the first conductive layer, the capacitive patches of the second layer separated from and overlapping a plurality of capacitive patches of the first layer.

53. The frequency selective surface of claim 32, the first conductive layer further comprising an inductive grid that surrounds the capacitive patches, wherein the capacitive patches are isolated from each other and the inductive grid.

54. The frequency selective surface of claim 53, wherein the second layer comprises capacitive patches isolated from each other and the capacitive patches and inductive grid of the first conductive layer, the capacitive patches of the second layer separated from and overlapping a plurality of capacitive patches of the first layer.

55. A single band artificial magnetic conductor comprising the frequency selective surface of claim 32 and a ground plane separated from the frequency selective surface.

56. An antenna comprising an antenna element on the artificial magnetic conductor of claim 55.

57. The antenna of claim 56, further comprising a vertical probe from a coaxial aperture in the ground plane, the vertical probe feeding the antenna element, the ground plane extended up along one edge of the artificial magnetic conductor so as to make conductive contact with at least some of the capacitive patches of the first conductive layer.

58. A planar integrated F antenna (PIFA) comprising the artificial magnetic conductor of claim 55, wherein the frequency selective surface is employed as a lid of the PIFA, the PIFA is connected to the ground plane at one end, has essentially an open circuit at an opposing end, and has a feed probe located between the one end and the opposing end.

59. A multi-resonant artificial magnetic conductor comprising the frequency selective surface of claim 32 and a ground plane separated from the frequency selective surface, the frequency selective surface containing at least one Lorentz pole.

60. An antenna comprising an antenna element on the artificial magnetic conductor of claim 59.

61. The antenna of claim 60, further comprising a vertical probe from a coaxial aperture in the ground plane, the vertical probe feeding the antenna element, the ground plane extended up along one edge of the artificial magnetic conductor so as to make conductive contact with at least some of the capacitive patches of the first conductive layer.

62. A planar integrated F antenna (PIFA) comprising the artificial magnetic conductor of claim 59, wherein the frequency selective surface is employed as a lid of the PIFA, the PIFA is connected to the ground plane at one end, has essentially an open circuit at an opposing end, and has a feed probe located between the one end and the opposing end.

63. A planar integrated F antenna (PIFA) comprising the frequency selective surface of claim 32 employed as a lid of the PIFA and a ground plane separated from the frequency selective surface.

* * * * *